US008026206B2

(12) United States Patent
Sajic et al.

(10) Patent No.: US 8,026,206 B2
(45) Date of Patent: Sep. 27, 2011

(54) LOW SOLIDS, HIGH VISCOSITY FABRIC SOFTENER COMPOSITIONS AND PROCESS FOR MAKING THE SAME

(75) Inventors: Branko Sajic, Lincolnwood, IL (US); Xue Min Dong, Lincolnshire, IL (US); Carmen Matache, Mount Prospect, IL (US); Christopher A. Gariepy, Northbrook, IL (US)

(73) Assignee: Stepan Company, Northfield, IL (US)

( * ) Notice: Subject to any disclaimer, the term of this patent is extended or adjusted under 35 U.S.C. 154(b) by 0 days.

(21) Appl. No.: 12/905,874

(22) Filed: Oct. 15, 2010

(65) Prior Publication Data

US 2011/0028381 A1 Feb. 3, 2011

Related U.S. Application Data

(63) Continuation of application No. 11/436,924, filed on May 18, 2006, now abandoned.

(60) Provisional application No. 60/682,163, filed on May 18, 2005.

(51) Int. Cl.
*C11D 1/835* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS

| | | | | |
|---|---|---|---|---|
| 4,137,180 | A | 1/1979 | Naik et al. | |
| 5,308,513 | A | 5/1994 | Harmalker et al. | |
| 5,433,869 | A | 7/1995 | Harmalker et al. | |
| 5,476,598 | A | 12/1995 | Schramm, Jr. et al. | |
| 5,545,350 | A * | 8/1996 | Baker et al. | 510/517 |
| 5,726,144 | A | 3/1998 | Dewez et al. | |
| 5,792,219 | A * | 8/1998 | Hartman et al. | 8/137 |
| 5,874,395 | A | 2/1999 | Ewbank et al. | |
| 6,180,594 | B1 | 1/2001 | Fender et al. | |
| 6,525,016 | B2 | 2/2003 | Liew | |
| 6,878,684 | B2 | 4/2005 | Ellson et al. | |
| 6,958,313 | B2 | 10/2005 | Caswell et al. | |
| 2002/0037825 | A1 * | 3/2002 | Demeyere et al. | 510/330 |
| 2002/0187911 | A1 | 12/2002 | Liew | |

FOREIGN PATENT DOCUMENTS

| | | |
|---|---|---|
| DE | 4229649 A1 | 3/1994 |
| DE | 4400927 | 7/1994 |
| DE | 4403686 | 8/1995 |
| DE | 19721589 A1 | 11/1998 |
| EP | 0 443 313 | 8/1991 |
| EP | 0 510 879 | 10/1992 |
| EP | 0638639 | 4/2000 |
| EP | 1239023 | 9/2002 |

(Continued)

OTHER PUBLICATIONS

R.R. Egan, "Cationic Surface Active Agents as Fabric Softeners," Journal of American Oil Chemists' Society, Jan. 1978, (vol. 55), pp. 118-121.

(Continued)

*Primary Examiner* — John R Hardee

(74) *Attorney, Agent, or Firm* — McAndrews, Held & Malloy, Ltd.

(57) ABSTRACT

Disclosed are low solids and high viscosity fabric softener compositions and processes for preparing them. The composition contains from about 0.05% to about 10% by weight of a rheology modifying fabric softening active comprising at least one long chain amine of the present technology, a derivative thereof, or a mixture thereof, and from about 1% to 10% by weight of an additional fabric softening active dispersed in water.

11 Claims, 4 Drawing Sheets

FOREIGN PATENT DOCUMENTS

| | | |
|---|---|---|
| EP | 1254203 | 6/2005 |
| GB | 1599171 | 9/1981 |
| GB | 2204608 | 11/1988 |
| JP | 63-295764 | 12/1988 |
| WO | WO9404642 | 3/1994 |
| WO | WO9708285 | 3/1997 |

OTHER PUBLICATIONS

Jeannene A. Ackerman, "How to Choose Cationics For Fabric Softeners," Journal of American Oil Chemists' Society, vol. 60, No. 6, Jun. 1983, pp. 1166-1169.

Matthew I. Levinson, "Rinse-Added Fabric Softener Technology at the Close of the Twentieth Century," Journal of Surfactants and Detergents, vol. 2, No. 2, Apr. 1999, pp. 223-235.

Matthew George and Richard G. Weiss, "Primary Alkyl Amines as Latent Gelators and Their Organogel Adducts with Neutral Triatomic Molecules," Langmuir, vol. 19, No. 4, 2003, pp. 1017-1025.

International Search Report, Nov. 2, 2006.

Communication Pursuant to Article 94(3) EPC corresponding to European Patent Application No. 06760171.6-2114, dated Feb. 24, 2010.

* cited by examiner

LOW SOLIDS, HIGH VISCOSITY FABRIC SOFTENER COMPOSITIONS AND PROCESS FOR MAKING THE SAME

RELATED APPLICATIONS

This application is a continuation application of U.S. Ser. No. 11/436,924, filed May 18, 2006, now abandoned, which application claims the benefit of U.S. Provisional Application No. 60/682,163, filed May 18, 2005, which is explicitly incorporated herein by reference in its entirety.

BACKGROUND OF THE INVENTION

The present invention relates generally to fabric softener compositions with improved stability and softening. The present invention further relates to processes for preparing the same.

Fabric softener (i.e., conditioning) compositions are commonly used to deposit a fabric softening compound onto fabric. Typically, such compositions contain a cationic fabric softening agent dispersed in water. Fabric softener compositions used in the rinse cycle are generally separated into two basic product categories based on solids (active softening agent/fabric softening active) concentration. Compositions containing more than 10% by weight (e.g., 10-50% or 15-25% by weight) solids are often referred to as "concentrated" compositions, and compositions containing less than 10% by weight (e.g., 3-5% by weight) solids are often referred to as "diluted" compositions. Compositions containing softening agent below 5% by weight are sometimes called "ultra dilute," while softening agent levels in the range of 5-10% by weight are sometimes called "semi-dilute." Dilute, ultra dilute and semi-dilute fabric softener compositions, each of which are all considered low solids (or low active) compositions, usually have very low viscosity (with minimal or no thickening agents (viscosity control agents)) due to the low active concentration.

In most cases, however, the viscosity of a fabric softener commercial product has a significant influence on consumer perception, especially in regional markets like Europe, Central America, Latin America and the Far East. In a broad sense, consumers associate a high viscosity with good performance and product quality. For example, fabric softeners for the Mexican market typically have an active concentration of about 5-7% by weight, but require a viscosity of about 300-400 cps; fabric softeners for the Brazilian market typically have an active concentration of about 5% by weight, but require a viscosity of about 1500-2000 cps; fabric softeners for the European market typically have an active concentration of about 4-5% by weight, but require a viscosity of about 100-400 cps; fabric softeners for the Philippines market typically have an active concentration of about 3-7% by weight, but require a viscosity of 500-700 cps; while fabric softeners for the China market typically have an active concentration of about 3-5% by weight, but require a viscosity of about 800-1500 cps. Unless otherwise indicated, the viscosity numbers in the present application can be obtained by a Brookfield RV model viscometer at 25° C. A person familiar with the field of the present application will understand that other equipment achieving the same outcomes for measurement purposes are within the spirit and scope of the present application.

Various additives have been used in fabric softener compositions in order to achieve the desired high viscosity. For example, polymeric thickening agents, such as starches and cellulose ethers, have been commonly used to increase the viscosity of low solids fabric softener compositions. However, these conventional viscosity control agents are expensive. Further, such agents are typically included at levels in the range of from about 0.05% to about 1% by weight, which in turn increases the cost of the resultant fabric softener compositions. Moreover, conventional polymeric thickening agents tend to generate a drop in viscosity in the fabric softener product during storage. Typically, such end products containing polymeric thickening agents require a separate gelatinization stage, in which they are mixed with water. This can increase the complexity and expense of the manufacturing process. Finally, conventional polymeric thickening agents typically do not add significant benefits to the overall softening performance of the end product. There is therefore a strong demand for a low solids, high viscosity fabric softener composition that has minimal or no polymeric additives.

U.S. Pat. No. 6,878,684 (Unilever Home & Personal Care USA, Greenwich, Conn.) discloses a fatty acid partial ester of a polyhydric alcohol that may act as a viscosity modifier, if the fabric conditioning composition containing a quaternary ammonium compound ("quat") is manufactured under certain conditions. The reference appears to describe that it is necessary to expose the fabric conditioning composition to shear at a temperature below the phase transition temperature of the quaternary ammonium compound.

In the present application, a quaternary ammonium compound or salt, or a derivative thereof may be generally referred to as a quat. An ester-containing quaternary ammonium compound or salt is sometime referred to as an ester quat. A quaternized amine may be referred to as an amine quat or quat of the amine, which can be, for example, a quaternized alkyl amine, a quaternized alkyl amido amine, or a quaternized ammonium polyamine. More information about quats, ester quats, and amine quats, especially about those that can be used for the present technology, is provided in the detailed description below.

U.S. Pat. No. 6,525,016 (Goldschmidt Chemical Corporation, Hopewell, Va.) discloses a high viscosity, low solids rinse cycle fabric softener formulation that includes a homogenous blend of (a) 50-90% by weight of at least one imidazolinium quaternary ammonium compound; and (b) 10-50% by weight of at least one amido amine quaternary ammonium compound. The reference appears to require that the at least one imidazolinium quaternary ammonium compound and the at least one amido amine quaternary ammonium compound be free of any unsaturated alkyl groups.

U.S. Pub. Pat. App. No. 2002/0187911 (Goldschmidt Chemical Company, Hopewell, Va.) discloses a high viscosity, low solids fabric softener formulation that uses at least one amine ethoxylate having the formula $(R(nEO))_sNH_t$, wherein R is a saturated or unsaturated, linear or branched alkyl group containing from 10 to 22, preferably from 12 to 18, carbon atoms; EO is ethoxylate; n is the number of moles of EO and is from 1 to 10, preferably from 2 to 5; s=1, 2, or 3; t=1, 1, or 2; and s+t=3, to enhance the viscosity of the composition without the use of polymeric thickening agents. The addition of the amine ethoxylate to the low solids fabric softener composition is alleged to not only enhance the viscosity, but also the softening performance, of the composition.

EP1254203B1 (Unilever PLC, United Kingdom) discloses a fabric conditioning composition that uses a stabilizing system containing at least one salt of a multivalent inorganic anion or non-sequestering multivalent organic anion to allegedly improve the viscosity of the conditioning composition. A mixture comprising sodium chloride and sodium sulfate is described as being preferably used. Additionally, there is at least one salt of a univalent anion in the mixture.

WO 97/08285 (Colgate/Palmolive Company, New York, N.Y.) discloses the use of fatty acid esters of mono or polyhydric alcohols as emulsion or dispersion stabilizers in fabric softening compositions containing 3-40% by weight of a fabric softener combination comprising an amido tertiary amine and an ester quat material. The weight ratio of the fabric softener combination to the fatty acid ester(s) of mono or polyhydric alcohol is in the range of from about 40:1 to about 5:1, while the level of the fatty acid ester(s) of mono- or polyhydric alcohol in the composition is in the range of from about 0.2% to about 2% by weight.

GB 2204608 (Kao Corporation, Japan) discloses liquid softener compositions containing a quaternary ammonium salt, a polyamide and an ester derived from a fatty acid having 10-24 carbon atoms and glycerol. The weight ratio of quaternary ammonium salt to ester is described as being in the range of from about 0.1:1 to 3:1.

JP 63-295764 (Kao Corporation, Japan) discloses soft finishing agents containing (a) a cationic textile softening substance, (b) a straight chain fatty acid and (c) an esterified product of fatty acid and glycerol. The molar ratio of (b):(a) is 0.001 to 0.2, the weight ratio of (b):(a) is 0.01 to 3, and the total amount of (a), (b) and (c) is 3 to 20 weight percent.

DE-A1-4400927 (Henkel, Germany) discloses aqueous solutions of quaternized fatty acid triethanolamine ester salts thickened by adding 0.01 to 0.1 wt % of esters of fatty acids with commercial oligoglycerol mixtures.

GB 1599171 (Procter & Gamble, Cincinnati, Ohio) discloses an aqueous textile treatment composition comprising a water insoluble cationic fabric softener, a water insoluble nonionic fabric softener, and from 0.1 to 10 wt % of an aromatic carboxylic acid. The nonionic fabric softener is present in an amount from 0.5 to 12 weight percent.

However, in light of the references noted above, there still remains a strong demand and unresolved need for a low solids, high viscosity fabric softener composition that contains minimal or no polymeric additives, exhibits improved softening, stability and viscosity performance properties as desired in different regions of the world, and is cost-effective to manufacture.

BRIEF SUMMARY OF THE INVENTION

The present technology provides fabric softener compositions and processes for preparing the same, which have improved stability and softening properties and achieve desirable viscosities without incorporating large quantities of expensive additional components. Preferred fabric softener compositions of the present technology are low solids, high viscosity (LSHV) compositions.

It has been unexpectedly found that there is a significant increase in dispersion viscosity by incorporating from about 0.05% to about 10% of a rheology modifying fabric softening active comprising at least one long chain amine of the present technology, a derivative thereof, or a mixture thereof in a fabric softener composition containing from about 0% to about 10% by weight of another fabric softening active dispersed in water. The dispersion is stable at normal room temperature and under high and low temperature conditions. It can also be stable under low to moderate shear conditions, and/or under acid conditions, for example, when the pH of the dispersion is from about 1.5 to about 7.0. The derivatives of the long chain amine can be, for example, an amine quat, a salt of the amine, or a mixture thereof.

In one aspect, the present technology provides a fabric softening composition which comprises, based on the total weight of the fabric softening composition:

(a) from about 0.05% to about 10% by weight of a rheology modifying rheology modifying fabric softening active comprising a long chain amine, a derivative thereof, or a mixture thereof, wherein the long chain amine has a general chemical structure of:

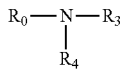

wherein, $R_0$ has a structure of $R_1$—A—$R_2$, where $R_1$ is a $C_{5-30}$ alkyl, alkylene, or alkenyl group, A is

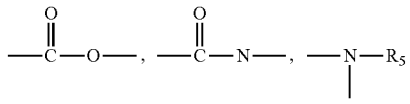

where $R_5$ is a hydrogen or $C_{1-6}$ alkyl group, a $C_{1-6}$ alkylene group, or a polyamine, $R_2$ is a $C_{1-6}$ alkylene group, a $C_{1-30}$ alkoxylated group, or a covalent bond, and $R_3$ or $R_4$ independently is the same as $R_1$—A—$R_2$, a $C_{1-5}$ alkyl group, or a hydrogen;

(b) from about 0% to about 10% by weight of an additional fabric softening active; and (c) from about 0% to about 2% by weight of an electrolyte, wherein the pH of the fabric softening composition is within the range of from about 1.5 to about 7.0.

Optionally, the liquid fabric softening composition of the present technology can contain a desired amount of fatty alcohol, fragrance, solvent or other additives.

The long chain amine of the presently described technology can be an alkyl amine, amido-amine, a polyamine, or an ester amine. Preferably the amine is saturated. More preferably, the amine can be a fully saturated alkyl amido-amine. For example, the fully saturated alkyl amido-amine to be used in the presently disclosed technology can be stearylamidopropyl dimethylamine (SAPDMA), derivatives thereof, or combinations thereof. The amido-amines may be prepared by reaction of amines with either fatty acids, fatty acid esters, or glycerides (with varying mono-, di-, or tri-content), and combinations or derivatives thereof.

The long chain amine of the presently described technology can be quaternized and used in the fabric softening composition as an amine quat, which can be, for example, a quaternized alkyl amine, a quaternized alkyl amido amine, or a quaternized ammonium polyamine. The amine salt included in one or more compositions of the present technology can be generated in situ by reacting the corresponding amine with a sufficient amount of an acid, preferably a polyhydric acid until the desired pH is reached. Pre-formed amine salts or amine quats can also be used. Both organic and inorganic acids are suitable for in situ reaction with an amine to generate the corresponding salts. Examples of acids include, but are not limited to, sulfuric acid, phosphoric acid, citric acid, maleic acid, adipic acid, boric acid, glutamic acid, succinic acid, half ester acid, xylene sulfonic acid, hydrochloric acid, lactic acid, derivatives thereof, and combinations thereof. The electrolyte is preferably an inorganic salt, such as NaCl, KCl, $CaCl_2$, $Na_2SO_4$, $MgCl_2$, $MgSO_4$, $(NH_4)_2SO_4$, an alternative thereof, an equivalent thereof, or a combination thereof.

In another aspect, the presently described technology provides a process to prepare a low solids, high viscosity liquid fabric softener composition of the present technology. The process can include the steps of:

(a) adding a proper amount of a rheology modifying fabric softening active, preferably pre-melted, comprising a long chain amine, a derivative thereof, or a mixture thereof as described above to a proper amount of water at from about 25° C. to about 70° C. to form a mixture;

(b) optionally, adding a proper amount of an additional fabric softening active, preferably pre-melted, to the mixture at from about 25° C. to about 70° C.;

(c) cooling the mixture to a temperature at about or under the re-crystallization/solidification phase transition temperature of the dispersed fabric softening active or actives as may be determined by using differential scanning calorimetry (DSC) or other suitable method for determining phase transition temperature(s) known to those skilled in the art; and (d) if the pH of the mixture is above 7.0 or above a desired range, adjusting the pH of the mixture to within the range of from about 1.5 to about 7.0 with an acid, preferably a polyhydric acid, at a temperature at about or under, preferably within from about 10° C. below to about 10° C. above, the re-crystallization/solidification phase transition temperature of the dispersed fabric softening active or actives to form a fabric softener composition.

The fabric softener composition produced can be further cooled to room temperature at about 25° C. or, optionally, can be heated to an elevated temperature (e.g., about 40° C.) for a period of time (e.g., approximately 10 minutes) and then cooled to room temperature.

The fabric softener composition produced is preferably a low solids, high viscosity (LSHV) composition. If desired, a sufficient quantity of an electrolyte solution can be added to the fabric softener composition of the present technology. The amount needed can be determined by performing a viscosity salt response test for a formulation system to achieve the desired viscosity.

In a further aspect, the presently described technology provides an alternative process for producing a fabric softener composition. This process can include the steps of:

(a) adding a molten pre-mix comprising a proper amount of a rheology modifying fabric softening active comprising a long chain amine, a derivative thereof, or a mixture thereof as described above and, optionally, a proper amount of an additional fabric softening active to a proper amount of water at from about 25° C. to about 70° C. to form a mixture;

(b) cooling the mixture to a temperature at about or under the re-crystallization/solidification phase transition temperature of the dispersed fabric softening active or actives as may be determined by using differential scanning calorimetry or other suitable method known to those skilled in the art for determining phase transition temperature(s); and (c) if the pH of the mixture is above 7.0 or a desired range, adjusting the pH of the mixture to within the range of from about 1.5 to about 7.0 with an acid, preferably a polyhydric acid at from about 10° C. below to about 10° C. above the re-crystallization/solidification phase transition temperature of the dispersed fabric softening active or actives to form a fabric softener composition.

The fabric softener composition produced can be further cooled to room temperature at about 25° C. or, optionally, can be heated to an elevated temperature (e.g., about 40° C.) for a period of time (e.g., approximately 10 minutes) and then cooled to room temperature at about 25° C.

Similarly, the fabric softener composition produced is preferably a low solids, high viscosity (LSHV) composition. A sufficient quantity of an electrolyte solution can be added to the fabric softener composition of the present technology.

In a yet further aspect of the present technology, the presently described technology provides another alternative process for producing a fabric softener composition. This process can include the steps of:

(a) adding a rheology modifying fabric softening active comprising a long chain amine, a derivative thereof, or a mixture thereof as described above to water in a first container at from about 25° C. to about 70° C. to form a first mixture;

(b) if the pH of the first mixture is above 7.0 or a desired range, adding an acid to the first mixture at from about 25° C. to about 70° C.;

(c) cooling the first mixture to from about 25° C. to about 30° C.;

(d) adding an additional fabric softening active to water in a second container at from about 25° C. to about 70° C. to form a second mixture;

(e) cooling the second mixture to from about 25° C. to about 30° C.; and (f) mixing the first mixture and the second mixture to form the fabric softener composition.

The fabric softener composition produced can, optionally, be heated to an elevated temperature (e.g., about 40° C.) for a period of time (e.g., approximately 10 minutes) without stirring and then cooled to room temperature. The composition produced is preferably a low solids and high viscosity (LSHV) fabric softener composition. And similarly, a sufficient quantity of an electrolyte solution can be added to the fabric softener composition of the present technology.

DETAILED DESCRIPTION OF AT LEAST SOME OF THE PREFERRED EMBODIMENTS

Figure 1:
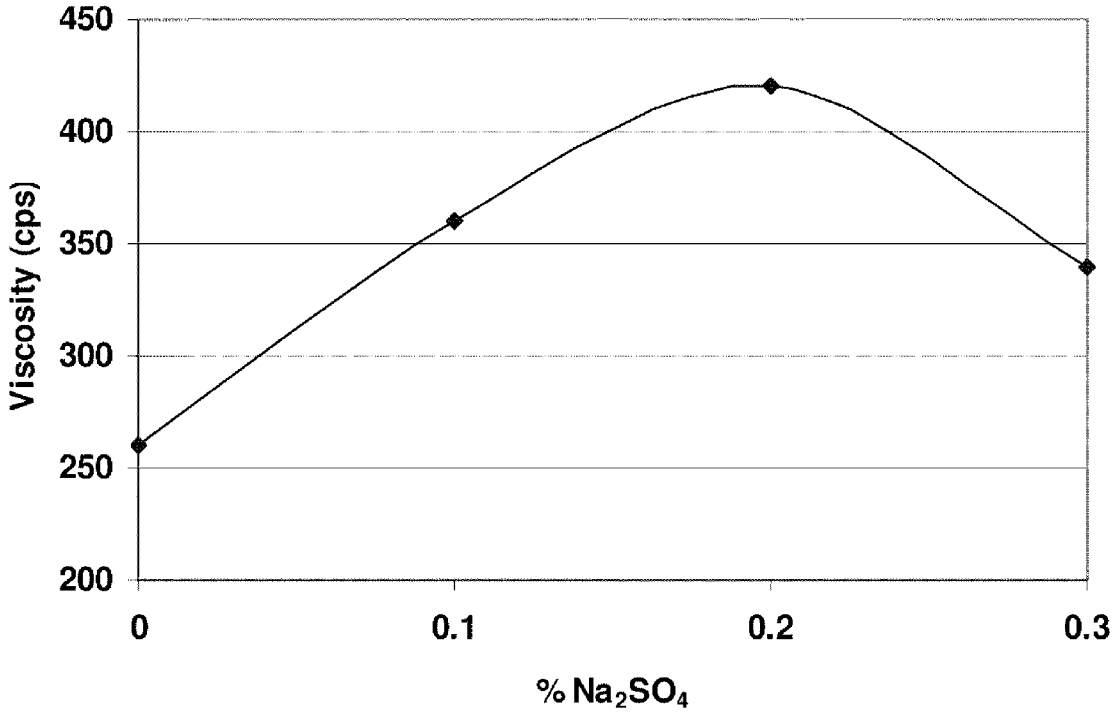
FIG. 1 illustrate the viscosity salt response test used to determine the proper amount of an electrolyte needed for a fabric softener composition in the present technology.

While the presently described technology will be described in connection with one or more preferred embodiments, it will be understood by those skilled in the art that the technology is not limited to only those particular embodiments. To the contrary, the presently described technology includes all alternatives, modifications, and equivalents as may be included within the spirit and scope of the appended claims.

The presently described technology relates to a cost effective, performance enhanced and efficient thickening system based on long chain amines or derivatives thereof and other fabric softening actives such as quaternary fabric softener molecules. The present technology is suitable for use in fabric softener compositions, especially low solids, high viscosity (LSHV) fabric softener compositions. By the term "fabric softening active," it means a compound or a mixture of compounds that has a fabric softening or conditioning property.

Long Chain Amines or Derivatives Thereof

The fabric softening composition of the presently described technology contains a rheology modifying fabric softening active, preferably consisting essentially of, at least one long chain amine, derivatives thereof, or a combination thereof. Derivatives of the long chain amine suitable for use in the present technology include, for example, amine quats, amine salts, and mixtures thereof. An amine quat can be, for example, a quaternized alkyl amine, a quaternized alkyl amido amine, or a quaternized ammonium polyamine.

The long chain amine in accordance with the present technology has a general chemical structure as follows:

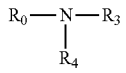

In this formula, $R_0$ has a structure of $R_1$—A—$R_2$, where $R_1$ is a $C_{5-30}$ alkyl, alkylene, or alkenyl group, A is

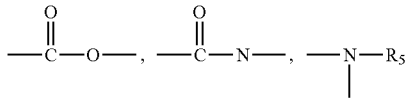

where $R_5$ is a hydrogen or $C_{1-6}$ alkyl group, a $C_{1-6}$ alkylene group, or a polyamine, $R_2$ is a $C_{1-6}$ alkylene group, a $C_{1-30}$ alkoxylated group, or a covalent bond, and $R_3$ or $R_4$ independently is the same as $R_1$—A—$R_2$, a $C_{1-5}$ alkyl group, or a hydrogen. The polyamine for the A group in $R_0$ can be, for example, a $C_{1-6}$ di- or tri-amine.

The long chain amine can be, for example, an alkyl amine, an amido-amine, an ester amine, a polyamine, a derivative thereof, and/or a combination thereof. Such long chain amines include, but are not limited to triethanol ester amines (TEA ester amines), methyldiethanol ester amines (MDEA ester amines), alkylamidopropyl amines, alkylamindoethyl amines, trialkyl ($C_{10}$-$C_{18}$) tertiary amines, dialkyl ($C_{10}$-$C_{18}$) methyl tertiary amines, monoalkyl ($C_{10}$-$C_{18}$) dimethyl tertiary amines, derivatives thereof, and/or combinations thereof.

Preferred long chain amines for the present technology include, for example, fatty amines derived from different sources such as stearyl, behenyl, oleyl, soya, palm stearine, palm kernel, palm, tallow, tall, sunflower, safflower, canola, castor, sesame, cotton seed, coconut, and babassu sources, derivatives thereof, or mixtures thereof. The long chain amines can be alkyl amines (e.g., tertiary amines), amido-amines (e.g., amidopropyl dimethyl amines, amidoethyl dimethyl amines, and amidopropyl diethyl amines), ester amines, or polyamines derived from these sources. Further, they can be hydrogenated or partially hydrogenated. Examples of suitable long chain alkyl amines include, but are not limited to, dioctylamine, stearyl dimethylamine, palmityl dimethylamine, oleocetyl dimethylamine, derivatives thereof, or combinations thereof.

More preferably, the long chain amines are saturated amido-amines. Even more preferably, the long chain amines are fully saturated alkyl amido-amines. The long chain amido-amines may be prepared by reaction of amines with either fatty acids, fatty acid esters, glycerides (with varying mono-, di-, or tri-content), or combinations or derivatives thereof. Examples of long chain amido-amines include, but are not limited to, stearyl amidoethyl diethyl amine, behenyl amidopropyl dimethyl amine, stearyl amidopropyl dimethyl amine, hard tallow amidopropyl dimethyl amine, hydrogenated soy amidopropyl dimethyl amine, oleyl amidopropyl dimethyl amine, stearyl amidoethyl dimethyl amine, stearyl amidopropyl diethyl amine, derivatives thereof, and combinations thereof. Other examples of long chain amines suitable for use in the present technology include ester amines, such as stearyl dimethyl ester amine.

All long chain amines in accordance with the present technology can be used in the form of, or in combination with derivatives thereof, such as long chain amine quats, long chain amine salts, or mixtures thereof. A person familiar with the field of the present technology will understand how to produce the long chain amine quats, long chain amine salts, or other derivatives of the long chain amines.

The long chain amine salt or amine quat of the present technology can be used in pre-formed format to make a fabric softener composition of the present technology. However, in accordance with at least one embodiment of the present technology, it is preferred to form the long chain amine salt in situ from the corresponding long chain amine or quat thereof to achieve optimal viscosity generation and improve the stability of the resultant fabric softener dispersion. The corresponding salt of a long amine of the present technology can be generated in situ by reacting the long chain amine with a sufficient quantity of acid until the desired pH, which preferably is within the range of from about 1.5 to about 7.0, is reached as described in more detail below. Both organic and inorganic acids can be used to react with one or more long chain amines in situ to generate the corresponding salts of the present technology.

The fabric softener compositions produced by the present technology normally have a pH within the range of from about 1.5 to about 7.0, alternatively from about 2.0 to about 5.0, alternatively from about 2.5 to about 4.5, alternatively from about 2.5 to about 4.0. If the pH of the fabric softener composition is above 7.0 or a desired range, an acid can be used to adjust the pH of the composition to within the desired range. Examples of suitable acids include, but are not limited to, sulfuric acid, phosphoric acid, citric acid, maleic acid, adipic acid, boric acid, glutamic acid, succinic acid, half ester acid, xylene sulfonic acid, hydrochloric acid, lactic acid, derivatives thereof, equivalents thereof, alternatives thereof, or combinations thereof. Polyhydric (i.e., poly-functional) acids are preferably used in the presently described technology to neutralize the long chain amines or long chain amine quats in situ and adjust the pH of the fabric softener compositions to a desired value.

The rheology modifying fabric softening active of the present technology based on the at least one long chain amine, derivatives thereof, or a combination thereof can be present in the fabric softener composition, which is preferably a low solids, high viscosity composition, in an amount sufficient to reach the desired viscosity for the composition. For example, the amount can be in the range of from about 0.05% to about 10%, alternatively from about 0.1% to about 5%, alternatively from about 0.3% to about 3%, alternatively from about 0.5% to about 1%, based on the total weight of the fabric softener composition.

Additional Fabric Softening Actives

In accordance with at least one embodiment of the present technology, the fabric softening composition can further include an additional fabric softening active, which can be any fabric softening active known in the field of invention that has a fabric softening or conditioning property. However, it should be understood that the additional fabric softening active does not have to be included in a fabric softener composition of the present technology. For example, in accordance with at least one other embodiment of the present technology, an alkyl amidopropyl dimethyl amine salt or amine quat (e.g., a SAPDMA salt or quat) can be used as the sole fabric softening active with self-thickening properties with and without an electrolyte.

The additional fabric softening active can comprise, for example, a cationic, nonionic, zwitterionic, or amphoteric compound, or a mixture thereof. For example, the fabric softening active may be a cationic fabric softening compound, such as a quaternary ammonium compound (i.e., a quat). Other examples of fabric softening actives can include, for example, glyceryl esters, propylene glycol esters, polyethylene glycol esters, glycerol, polyglycerol esters, quaternized celluloses, quaternized guar gum, quaternized silicones, and amino-functionalized silicones, derivatives thereof, and combinations thereof.

For example, the fabric softening compound for the additional fabric softening active can be a cationic compound having two long chain alkyl or alkenyl chains with an average chain length greater than about $C_{14}$. Preferably, each chain has an average chain length greater than about $C_{16}$, alternatively at least about 50% of the long chain alkyl or alkenyl groups have a chain length of about $C_{18}$ or more. Particularly preferred alkyl chains are derived from animal or plant sources including, but not limited to, tallow, palm oil, soy oil, or other vegetable oils. The alkyl chains can also be from petroleum-derived compounds.

One known species useful in the practice of the present technology are substantially water-insoluble quaternary ammonium compounds have the following general formula:

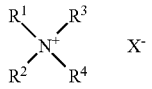

wherein $R^1$ and $R^2$ represent the same or different hydrocarbyl groups having from about 12 to about 24 carbon atoms; $R^3$ and $R^4$ represent the same or different hydrocarbyl groups containing about 1 to about 4 carbon atoms; and X is an anion, preferably selected from halide, methyl sulphate or ethyl sulphate radicals.

Representative examples of these quaternary softeners include, for example, di(tallow alkyl)dimethyl ammonium methyl sulphate; dihexadecyl dimethyl ammonium chloride; di(hydrogenated tallow alkyl)dimethyl ammonium chloride; dioctadecyl dimethyl ammonium chloride; di(hydrogenated tallow alkyl)dimethyl ammonium methyl sulphate; dihexadecyl diethyl ammonium chloride; di(coconut alkyl)dimethyl ammonium chloride; ditallow alkyl dimethyl ammonium chloride; and di(hydrogenated tallow alkyl)dimethyl ammonium chloride, and combinations thereof.

Other preferred quaternary softeners can contain ester or amide links, such as those available under the trade names ACCOSOFT® (available from Stepan Company, Northfield, Ill.), VARISOFT® (available from Degussa Corporation, Parsippany, N.J.), and STEPANTEX® (available from Stepan Company).

It is especially preferred that the additional fabric softening active of the present technology be a water insoluble quaternary ammonium material which comprises a compound having at least two or more $C_{12-18}$ alkyl or alkenyl groups connected to the molecule via at least one ester link. It is more preferred that the quaternary ammonium compound have two or more ester links present. The especially preferred ester-linked quaternary ammonium compounds (i.e., ester quats) for use in the presently described technology can be represented by the formula:

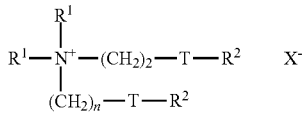

wherein each $R^1$ group is independently selected from $C_{1-4}$ alkyl, hydroxyalkyl (e.g. hydroxyethyl) or $C_{2-4}$ alkenyl groups; and wherein each $R^2$ group is independently selected from $C_{8-28}$ alkyl or alkenyl groups; T is

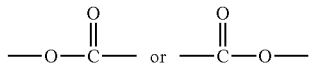

$X^-$ is any suitable anion and n is 0 or an integer from 1-5.

Preferred compounds of this class of cationic fabric softening compounds suitable for use in various compositions of the present technology include, for example, di-alkenyl esters of triethanol ammonium methyl sulphate and N,N-di(tallowoyloxy ethyl)N,N-dimethyl ammonium chloride. Commercial examples of compounds include, but are not limited to, TETRANYL® AOT-1 (di-oleic ester of triethanol ammonium methyl sulphate 80% active by weight), TETRANYL® A0-1 (di-oleic ester of triethanol ammonium methyl sulphate 90% active by weight), TETRANYL® L1/90 (partially hardened tallow ester of triethanol ammonium ethyl sulphate 90% active by weight), TETRANYL® L5/90 (palm ester of triethanol ammonium methyl sulphate 90% active by weight), and TETRANYL® AHT-1 (hardened tallow ester of triethanol ammonium methyl sulphate 90% active by weight), all available from Kao Corporation, Japan, and REWOQUAT® WE15 ($C_{10}$-$C_{20}$ and $C_{16}$-$C_{20}$ unsaturated fatty acid reaction products with triethanolamine dimethyl sulphate quaternized 90% active by weight), available from Witco Corporation, Greenwich, Conn.

A second preferred type of quaternary ammonium material of the present technology can be represented by formula:

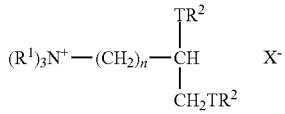

wherein $R^1$, $R^2$, T, $X^-$ and n are as defined above. Preferred compounds of this type include, for example, 1,2 bis[hardened tallowoyloxy]-3-trimethylammonium propane chloride, and their methods of preparation are, for example, described in U.S. Pat. No. 4,137,180 (Lever Brothers Company, New York, N.Y.). Preferably these materials comprise small amounts of the corresponding monoester as described in U.S. Pat. No. 4,137,180 such as a 1-hardened tallowoyloxy-2-hydroxy trimethylammonium propane chloride.

It is advantageous for environmental reasons that the quaternary ammonium material for the present technology be biologically degradable, for example, such as those materials described in U.S. Pat. No. 6,958,313 (The Procter & Gamble Company, Cincinnati, Ohio).

The additional fabric softening active may also be a polyol ester quat (PEQ) as described in EP 0638 639 (Akzo Nobel, Netherlands). Other additional fabric softening actives may also be applicable in the present technology. For example those described in "Cationic surface active agents as fabric softeners," R. R. Egan, Journal of American Oil Chemist Society, January 1978, Pages 118-121; "How to chose cationic for fabric softeners," J. A. Ackerman, Journal of American Oil Chemist Society, June 1983, pages 1166-1169; and "Rinse-Added Fabric Softener Technology at the Close of the Twentieth Century," M. I. Levinson, Journal of Surfactants and Detergents, April 1999, Vol. 2, Pages 223-235, incorporated herein as references.

Examples of quaternary ammonium compounds suitable for use in the additional fabric softening active of the presently described technology include, but are not limited to, triethanolamine (TEA) ester quats (e.g., methyl bis(ethyl tallowate)-2-hydroxyethyl ammonium methyl sulfate), methyldiethanolamine (MDEA) ester quats, diamidoquats (e.g., methyl bis(hydrogenated tallow amidoethyl)-2-hydroxyethyl ammonium methyl sulfate), and dialkyldimethyl quats (e.g., dihydrogenated tallow dimethyl ammonium chloride). Preferred ester quats are those made from the reaction of alkyl fatty acid fraction, methyl ester and triglyceride with triethanolamine where the fatty acid and methyl ester: tertiary amine mole ratio is in the range of from about 1:1 to about 2.5:1. Specific commercially available examples of the suitable additional fabric softening active include, but are not limited to, the STEPANTEX® series products (e.g., VT-90, SP-90, and VK-90) and the ACCOSOFT® series products (e.g., 400, 440-75 and 275), all available from Stepan Company.

The additional fabric softening active is preferably present at a level in the range of from about 0% to about 15%, alternatively from about 1% to about 10%, alternatively from about 2% to about 8%, alternatively from about 3% to about 7% by weight based on the total weight of the fabric softener composition.

Electrolytes

The fabric softener composition of the present technology preferably includes at least one electrolyte (inorganic salt) in the amount of from about 0% to about 3%, alternatively from about 0.01% to about 2%, alternatively from about 0.05% to about 0.5%, alternatively from about 0.1% to about 0.3%, based on the total weight of the fabric softener composition. Examples of suitable electrolytes include, but are not limited to, NaCl, KCl, $CaCl_2$, $Na_2SO_4$, $MgCl_2$, $MgSO_4$, $(NH_4)_2SO_4$, $NH_4Cl$, sodium citrate, $NaNO_3$, NaBr, sodium chlorate, sodium salicylate, alternatives thereof, equivalents thereof, derivatives thereof, or combinations thereof.

In accordance with at least one embodiment of the present technology, the addition of the electrolytes can further increase the viscosity of the fabric softener compositions, as well as improve their high temperature stability. The amount of the at least one electrolyte needed for a formulation system to achieve the desired viscosity can be determined by performing a viscosity salt response test. In accordance with the viscosity salt response test, different amounts of a salt (electrolyte) are added to a series of samples of the same fabric softener composition, and the impact of the salt on thickening is determined by measuring the viscosities of the samples. A viscosity versus salt concentration graph such as the one shown in FIG. 1 can be prepared which allows one to extrapolate the salt concentration required to obtain the desired viscosity. FIG. 1 shows the viscosity versus salt concentration graph for a composition of about 5% by weight of a STEPANTEX® VT-90 ester quat/SAPDMA mixture at about 9:1 active ratio. $Na_2SO_4$ is used as the electrolyte in this example. The graph of FIG. 1 shows that about 0.2% by weight of $Na_2SO_4$ will give the highest viscosity of about 420 cps at 25° C.

Other Optional Ingredients

Fatty alcohols such as stearyl alcohol may be included in the fabric softener compositions of the present technology to serve as low temperature stabilizing agents. When included, fatty alcohols are preferably present at a level of from about 0.1% to about 1.5% by weight based on the total weight of the fabric softener composition.

Fatty acids, such as stearic acid, may be included in the fabric softener compositions of the present technology to further increase formulation viscosity. When included, fatty acids are preferably present at a level of from about 0.1% to about 5.0% by weight based on the total weight of the composition.

The fabric softener compositions of the present technology may also contain optional additional stabilizing agents, including, for example, nonionic stabilizers, polymers, and additional viscosity control agents, as they are known in the art.

One or more oils may also present in the fabric softener compositions of the present technology. The oil can function as a co-softener and lubricant, and can improve ease of ironing and perfume longevity when the final fabric softening composition is applied to a substrate such as a fabric. It is also believed that the oil has an effect on the physical than of the product. The oil can be a mineral oil, ester oil or a silicone oil. Natural oils, such as vegetable oils, may also be included. The oil is preferably hydrophobic. Preferably, the oils are liquid at room temperature and are emulsified in the fabric conditioning compositions. When included, oils are preferably present in an amount of from about 0.01% to about 10%, alternatively from about 0.05% to about 5%, alternatively from about 0.1% to about 4% , alternatively from about 0.1% to about 1% by weight based on the total weight of the fabric softener composition.

The fabric softener compositions of the presently described technology can also contain one or more other optional ingredients, such as non-aqueous solvents, pH buffering agents, perfumes or fragrances, perfume carriers, colorants, hydrotropes, antifoaming agents, opacifiers, anti-corrosion agents, etc. For example, fragrance can be added before or after the optional electrolyte (inorganic salt, for example $CaCl_2$) is added.

An additional fabric treatment agent such as insect control agents, hygiene agents or compounds used to prevent the fading of colored fabrics can further be included in the fabric softener compositions of the present technology.

Resultant Product Form

Fabric softener compositions of the present technology are preferably low solids (ultra dilute, dilute or semi-dilute) fabric softener compositions for use in the rinse cycle of a laundry process, in particular the rinse cycle of a domestic or industrial laundry process. The total weight of solids, which include all fabric softening actives in the fabric softener composition of the present technology, can be more than about 15% by weight, but typically is less than about 15%, alternatively less than about 10%, alternatively less than about 7%, alternatively less than about 5% based on the total weight of the composition. The term "low solids" is used in the present application to describe a fabric softener composition that contains no more than 10% by weight of fabric softening actives based on the total weight of the fabric softener composition. The compositions are preferably present as an emulsion, a dispersion, or a mixture thereof.

The fabric softener compositions according to the present invention preferably exhibit an initial viscosity in the range of from about 100 centipoises (cps) to about 4000 cps, alternatively from about 150 cps to about 1500 cps, alternatively from about 300 cps to about 800 cps, alternatively from about 350 cps to about 500 cps, all at 25° C. The term "high viscosity" is used in the present application to describe a fabric softener composition that has an initial viscosity of at least 100 cps at 25° C. Unless otherwise noted, viscosities in the present technology are suitably measured using a Brookfield viscometer, RV model, available from Brookfield Engineering Laboratories, Middleboro, Mass. at 25° C. Viscosities can also be measured by other equipment known in the art, for example, by using a rheometer.

It is at least one advantage of the present technology that viscosities in the desired ranges, for example those viscosity ranges noted above, can be achieved without the use of, or with minimal use of, expensive additional viscosity control agents. According to a preferred embodiment of the present technology, additional viscosity control agents such as polymeric viscosity control agents can be present at a level of less than about 0.5% by weight, alternatively less than about 0.2% by weight, alternatively less than about 0.1% by weight, alternatively less than about 0.05% by weight, alternatively less than about 0.02% by weight.

It has also been surprisingly found that fabric softener compositions according to the presently described technology exhibit very stable viscosity during storage and can reduce or avoid the negative effects of fatty acids and amines resulting from the degradation of ester quats dispersed in the compositions.

Processing

It has been found that the addition of a long chain amine (or a derivative thereof or combinations thereof) as described above to a dispersion of at least one other fabric softening compound, preferably a cationic softening compound, and the neutralization of the long chain amine (or a derivative thereof) to generate a salt thereof in situ, can increase the viscosity of the dispersion to a desired level without the aid of other viscosity control agents. While a pre-formed long chain amine salt or long chain amine quat of the present technology can be added to a dispersion of the fabric softening compound to increase its viscosity, it is preferred to form the long chain amine salt in situ in the presence of the other fabric softening compound to achieve optimal viscosity generation and improve the stability of the fabric softener dispersion in accordance with at least one embodiment of the present technology.

It has been unexpectedly discovered that long chain amine salts, especially those resulting from neutralizing a long chain amine in situ with an acid, preferably a polyhydric acid, in the presence of a quaternary ammonium compound, afford high viscosity to a low active (i.e., low solids) fabric softener dispersion/composition. Lamellar and multi-layered lamellar vesicle structures have been observed under cross-polarized microscope or Cryo-TEM (transmission electron microscopy) imaging in the low solids, high viscosity fabric softener compositions of the present technology. Although not intending to be bound by any particular theory, it is believed that vesicle formation can result in defined cells, which can increase the viscosity of the fabric softener composition. If the long chain amine salt is formed in situ by neutralizing the long chain amine with an acid during the vesicle formation, a network of the vesicles can be formed. The resultant long chain amine salt can also osmotically shrink the vesicles and form further bridging between the vesicles.

Figure 2:
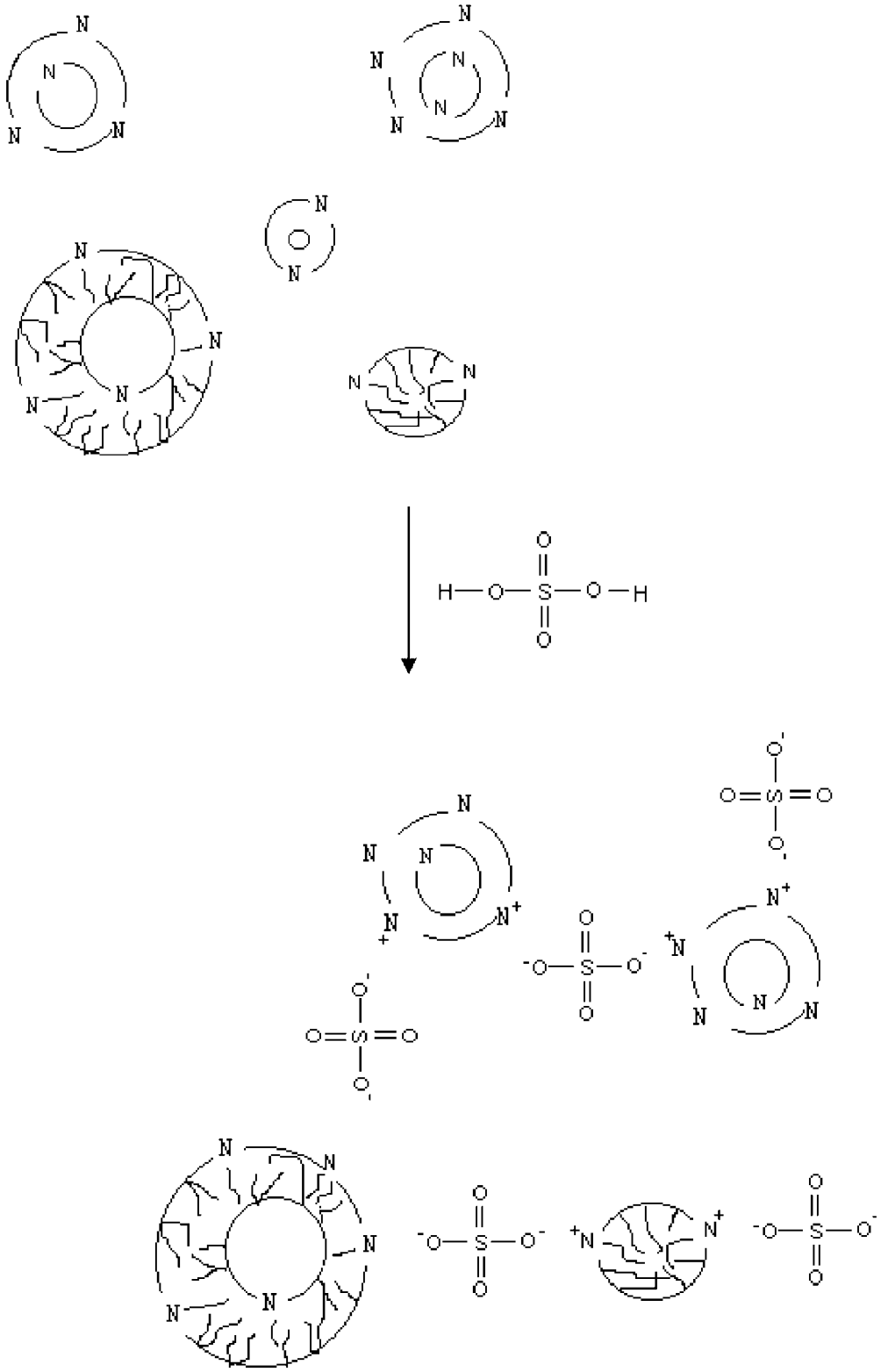
FIG. 2 illustrates a proposed thickening mechanism via network formation between amine molecules present in fabric softener particles and poly-functional acid molecules of the present technology.

Polyhydric acids can be effective in building viscosity of low solids fabric softener dispersions. Although not intending to be bound by any particular theory, a proposed thickening mechanism is illustrated in FIG. 2. As shown in FIG. 2, in light of the polyhydric acid being used for neutralization, one acid molecule can react with more than one long chain amine molecule to maintain a balance of charges. It should be noted that the fabric softening actives of the present technology can form dispersed particles in some embodiments, but form isotropic liquids in some other embodiments. Not intending to be bound by any particular theory, it is further believed that the determination as to whether the compositions of the present technology will be dispersions with particles or isotropic liquids (e.g., an isotropic clear liquid) will depend upon the degree of saturation of the fabric softening actives, the number of alkyl groups in the fabric softening actives, and the acid utilized during processing as described herein. FIG. 2 illustrates at least one of these situations where particles are formed by the dispersed fabric softening actives such as, for example, the dispersed long chain amine or derivatives thereof and the fabric softening quats (which are the additional fabric softening active in this example).

As shown in FIG. 2, the long chain amine molecules and the fabric softening quats can be packed into lamellar layers in the dispersed particles. Therefore, multiple long chain amine molecules from the same particle may not be readily available to react with the same acid molecule because of the space limitation or stearic barrier. This condition can promote one acid molecule to react with long chain amine molecules from different lamellar particles. As a result of cross-particle interactions, a very efficient vesicle network between and/or among fabric softener dispersion particles can be built, which can result in a viscosity increase. Similarly, it is believed that in the isotropic liquid formed by the fabric softening actives of the present technology, a vesicle network can be built as well. The network formed can be, for example, a liquid crystal gel network or a bi-layer lamellar gel network. The gel network of the present technology can be a 3-D (dimensional) network.

Furthermore, it is believed that formation of the network can also improve the stability of the fabric softener composition and maintain the desired viscosity for an extended period of time at different temperatures and humidities, and across a wide range of viscosity requirements for different parts of the world. Quaternary ammonium compounds used in fabric softener compositions such as ester quats can degrade over time to produce fatty acids and other degradation by-products, which can disrupt the stability of a fabric softener system. Although the long chain amines of the present technology and derivatives thereof may not be able to reduce the degradation rate, they can prevent the negative outcomes of the fatty acid and other degradation products from effecting the overall vesicle network.

Not intending to be bound by any particular theory, the vesicles are believed to be capable of trapping the degradation products, and prevent entire network failure or breakdown. Thus, the vesicles in the long chain amine based fabric softener composition of the present technology can help generate and maintain a gel network structure even when the ester quat degrades, which can reduce the disruption of an entire network system. Thus, the viscosity of the softener of the present technology may not increase significantly (e.g., to the point of crystallizing the fatty acids and other ester quat degradation products such that the fabric softener composition will not pour out of a container) over an extended period of time.

In addition, as the degradation products are produced, the gel network is believed to have the effect of "squeezing out" the fatty acid and other degradation products from the network, thus the network merely tightens further to stabilize itself without a significant increase in viscosity. Again, the viscosity of the softener composition of the present technology can be maintained or only minimally increased over an extended period of time as compared to conventional fabric softener compositions. For example, during the experiment described in Example 9 below, it has been surprisingly found that a fabric softener composition produced in accordance with the present technology can be maintained at a desirable viscosity at 45° C. for approximately 12 weeks.

Further, it has been unexpectedly discovered that performing the in situ neutralization of the long chain amine with the poly-functional acid at a proper temperature can help build the instant network structure and the resultant viscosity of the fabric softener composition. The neutralization temperature is product dependent. Preferably, the neutralization temperature can be at about or under the lower phase transition temperature (i.e., the re-crystallization or solidification temperature) of the dispersed fabric softener active or active mixture for making desirable fabric softener dispersions, especially those of low solids and high viscosity. For example, the neutralization can be within the range of from about 10° C. below to about 10° C. above, alternatively from about 10° C. below to about 3° C. above, alternatively from about 10° C. below to about 1° C. above, alternatively from about 10° C. below to about 1° C. below, alternatively from about 5° C. below to about 5° C. above, alternatively from about 5° C. below to about 1° C. above, alternatively from about 5° C. below to about 2° C. below, alternatively from about 3° C. below to about 3° C. above, alternatively from about 3° C. below to about 1° C. below the re-crystallization/solidification temperature of the dispersed fabric softening active or mixture of actives.

In the context of the present technology, the phase transition temperature used to measure the cooling or neutralization temperature refers to the lower phase transition temperature (i.e., the re-crystallization/solidification temperature) of the fabric softening compound (and not the higher phase transition temperatures such as the melting point temperature of the dispersed fabric softening active or actives). Typically, the re-crystallization/solidification temperature is in the range of from about 30° C. to about 70° C., alternatively from about 40° C. to about 50° C., for cationic softeners with long (greater than about $C_{18}$) saturated chains. For softeners comprising partially saturated or unsaturated chains, this temperature may be within the range of from about 20° C. to about 50° C., alternatively from about 25° C. to about 40° C.

Figure 3:
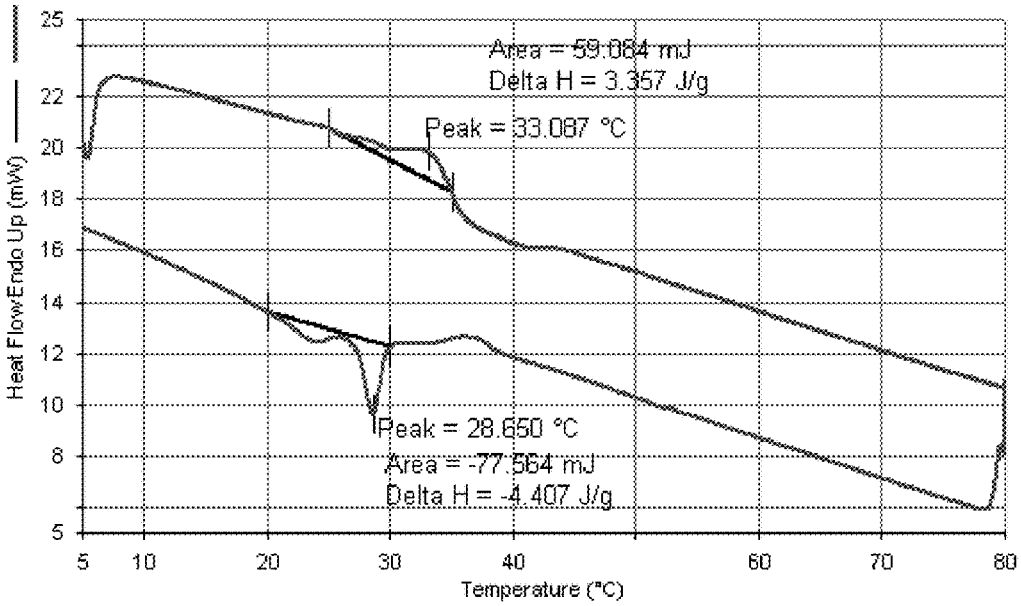
FIG. 3 illustrates a differential scanning calorimetry (DSC) graph for dispersion particles of a mixture of STEPANTEX® VT-90 ester quat and SAPDMA at a ratio of about 9:1 in accordance with the presently described technology.

One way to determine the solidification temperature for a given kind of dispersed fabric softening active or active mixture is by using differential scanning calorimetry (DSC). For example, the DSC graph of a dispersed mixture of STEPANTEX® VT-90 ester quat and SAPDMA at about a 9:1 active ratio is shown in FIG. 3. FIG. 3 indicates that the phase transition temperatures of the dispersed phase of the STEPANTEX® VT-90/SAPDMA mixture are 33° C. for melting point and 28.6° C. for solidification/re-crystallization point. Therefore, the neutralization temperature for the dispersion comprising the mixture of STEPANTEX® VT-90 ester quat and SAPDMA at about a 9:1 ratio can be determined to be about 28.6° C. Using the same method, the re-crystallization/solidification phase transition temperature for dispersed STEPANTEX® VT-90 ester quat, itself, is determined to be about 27° C.

Other methods known in the art that can determine the solidification/re-crystallization phase transition temperature of a fabric softening active or mixture of actives can also be used in the presently described technology. Such methods include, for example, those using microscopy, rheology, melting point test device, etc.

Although not intending to be bound by any particular theory, it is contemplated that if the neutralization for a fabric softener composition of the present technology is carried out at a temperature well above the solidification/re-crystallization temperature of the fabric softening active or active mixture, the lamellar/vesicle structures of the dispersion or isotropic liquid can be destroyed during the cooling process. This outcome indicates that the lamellar/vesicle structure can be sensitive in a liquid state. The network formed between the poly-functional acid and the long chain amine is stronger than the liquid crystal structure. The liquid crystalline-gel like structure breaks apart under shear in order to promote the neutralization reaction. When the lamellar/vesicle structure breaks, the network does not function efficiently to build viscosity of the fabric softener dispersion or isotropic liquid.

Although not intending to be bound by any particular theory, it is further contemplated that if the neutralization is performed at a temperature that is far below the solidification/re-crystallization temperature for the dispersed fabric softening active or active mixture, the lamellar/vesicle structure can be present in a solid state. In such cases, it can be difficult for the poly-functional acid molecules to penetrate into the layered structure in order to react with the long chain amine molecules buried inside the particulate structure. As a result, the desired network cannot form and the desired viscosity increase will not occur.

On the other hand, it is also contemplated that at temperatures close to the solidification temperature, the lamellar/vesicle structure can be at a swollen or semi-solid stage. In this state, poly-functional acid can easily penetrate into the dispersion particle structure to react with the long chain amine. This can result in amine salt formation that promotes the formation of the lamellar/vesicle structure and the network thereof, which in turn, can be responsible for the viscosity increase of the resultant fabric softener composition. Also, the semi-solid lamellar structure of the fabric softener dispersion is believed to still have enough shear stability to resist severe deformation while maintaining desirable network formation between the amine and the poly-functional acid.

In accordance with at least one embodiment of the present technology, at least one electrolyte (inorganic salt) as described above is preferably included in the fabric softener composition. Although not intending to be bound by any particular theory, it is believed that the electrolyte can osmotically shrink the network vesicles formed in the fabric softener composition(s) of the present technology. The electrolyte can cause bridging or linking between the vesicles such that the vesicles cannot slip by one another like in conventional fabric softeners. Thus, the electrolyte can shrink the vesicles and bridge them, which in turn can cause an increase in viscosity. In contrast, when inorganic salts are added to conventional fabric softeners employing polymeric viscosity controllers, the salts will typically reduce the viscosities of such softeners.

It has been further found that when the electrolyte is added to the fabric softener composition of the present technology, the viscosity increase will continue until a certain weight percentage limit of the electrolyte is reached, after which point, if more electrolyte is added, the vesicle structure may be harmed. Therefore, the amount of the electrolyte(s) added to the fabric softener composition of the present technology can be less than about 3%, alternatively less than about 2%, alternatively from about 0.05% to about 0.5%, alternatively from about 0.1% to about 0.3% by weight based on the total weight of the composition. Although not intending to be bound by any particular theory, it is believed that before the percentage limit of electrolyte is reached, as more electrolyte is added and the water content is lowered in the network due to the addition, the vesicles can become more rigid. It is believed that this can increase the rigidity and structural integrity of the network and maintain the network for an extended period of time.

In accordance with several embodiments of the presently described technology, the fabric softener compositions, especially those of low solids and high viscosity, can be prepared using one or more of the processes described below.

Process Option 1:

An amount of water sufficient to disperse or dissolve the subject long chain amine, a derivative thereof, or a combination thereof can be heated to from about 25° C. to about 70° C., alternatively from about 35° C. to about 65° C., alternatively from about 45° C. to about 65° C., alternatively from about 45° C. to about 55° C., alternatively about 60° C. to about 65° C. Depending on the formulation of the final fabric softener composition desired, a proper amount of a rheology modifying fabric softening active containing at least one long chain amine of the present technology, a derivative thereof, or a combination thereof, which is preferably pre-melted, and optionally a proper amount of at least one fatty alcohol are added to the pre-heated water under the condition of low shear agitation to form a mixture. The mixture can be agitated for a sufficient time (e.g., approximately from about 3 to about 5 minutes) until the long chain amine or its derivative or the combination thereof is dispersed or dissolved.

Depending on the formulation of the final fabric softener composition, optionally a proper amount of an additional fabric softening active (e.g., an ester quat) as described above, which is preferably pre-melted, can be slowly added to the mixture. The mixture can be agitated for a sufficient time (e.g., approximately from about 10 to about 15 minutes) while maintaining the temperature at from about 25° C. to about 70° C., alternatively from about 35° C. to about 65° C., alternatively from about 45° C. to about 65° C., alternatively from about 45° C. to about 55° C., alternatively from about 60° C. to about 65° C.

The fabric softener mixture can be cooled to a temperature of about or under the re-crystallization/solidification phase transition temperature of the fabric softening active or actives as determined, for example, using differential scanning calorimetry (DSC). Preferably, the mixture can be cooled to within from about 10° C. below to about 10° C. above, alternatively from about 5° C. below to about 5° C. above, alternatively from about 3° C. below to about 3° C. above the re-crystallization/solidification temperature of the fabric softening active or actives. For example, when STEPANTEX® VT-90 ester quat and SAPDMA are used as the two fabric softening actives, the mixture can be cooled to from about 20° C. to about 29° C., alternatively from about 22° C. to about 28° C., alternatively from 24° C. to 27° C. The cooling is preferably done quickly, for example, at a rate of from about 1° C. to about 15° C., alternatively from about 4° C. to about 10° C. per minute.

As an option for quick cooling the dispersion, a low energy emulsification method can be used. According to this method, the fabric softening active(s) can be dispersed or dissolved in a proper low amount of warm water (e.g., at about 35° C. to 65° C.) to form a concentrated mixture with good mixing, followed by the addition of a sufficient amount of cold water (e.g., at about 5° C. to 20° C.) in order to dilute the concentrated dispersion to a predetermined low active concentration. In this case, the mixture temperature can drop instantly to the preferred acidification temperature at about or under the re-crystallization/solidification phase transition temperature as described above.

If the pH of the fabric softener mixture is above 7.0 or a desired range, the pH of the mixture can be adjusted to between about 1.5 to 7.0, alternatively between about 2.0 to about 5.0, alternatively between about 2.5 to about 4.0, with a sufficient amount of an acid at temperatures at about or under, preferably, within about ±10° C., alternatively about ±5° C., alternatively about ±3° C. of, the re-crystallization/solidification phase transition temperature of the dispersed fabric softening active or actives. The resultant fabric softener composition can then be further cooled to room temperature (e.g., from about 20° C. to about 30° C., preferably at about 25° C.) using slow agitation. Optionally, the fabric softener composition being produced can be re-heated to an elevated temperature (e.g., at about 40° C.) for a period of time (e.g., approximately 10 minutes), preferably without stirring, before being cooled to room temperature.

For better structuring and improved high temperature stability, at least one electrolyte (inorganic salt) as described above can be added to the fabric softener composition with agitation at about 25° C. (after the further cooling) or at about the re-crystallization/solidification phase transition temperature of the fabric softening active or actives (before the further cooling) in the amount of up to about 3% by weight based on the total weight of the final composition to achieve a desired viscosity. Preferably, the electrolyte is added slowly with minimal agitation. The amount needed can be easily and conveniently determined by, for example, running the viscosity salt response test as described above for a given formulation system. Although not intending to be bound by any particular theory, it is believed that electrolytes can osmotically shrink the cooled network.

Process Option 2:

A rheology modifying fabric softening active comprising at least one long chain amine, a derivative thereof, or a mixture thereof as described above and, optionally, an additional fabric softening active can be mixed in a suitable container (e.g., a covered glass container) at from about 25° C. to about 70° C., alternatively from about 35° C. to about 65° C., alternatively from about 45° C. to about 65° C., alternatively from about 45° C. to about 55° C., alternatively from about 60° C. to about 65° C., to form an active pre-mix, preferably a molten state active pre-mix. Preferably the rheology modifying fabric softening active and the additional fabric softening active are mixed in an active ratio of from about 10:1 to about 1:20 by weight, alternatively from about 1:1 to about 1:10 by weight; alternatively from about 1:4 to about 1:9 by weight. For example, when STEPANTEX® VT-90 ester quat and SAPDMA are used, for a 5% by weight active fabric softener composition, SAPDMA and the STEPANTEX® VT-90 ester quat can be mixed at a ratio of about 1:4.44 by weight. For another example, for a 7% by weight active fabric softener composition, SAPDMA and the STEPANTEX® VT-90 ester quat can be mixed at a ratio of about 1:10 by weight. The molten pre-mix may further include additional optional ingredients such as a fatty alcohol as described above. Mixing of the components can stop when a homogeneous blend is formed. In at least one embodiment of the present technology, it can take approximately from about 10 to about 15 minutes to obtain a homogenous molten pre-mix.

Depending on the formulation of the final fabric softener composition to be produced, a proper amount of water can be heated to a temperature of from about 25° C. to about 70° C., alternatively from about 35° C. to about 65° C., alternatively from about 45° C. to about 65° C., alternatively from about 45° C. to about 55° C., alternatively from about 60° C. to about 65° C. The molten pre-mix from the first container can be added to this pre-heated water in a second container at from bout 25° C. to about 70° C., alternatively from about 35° C. to about 65° C., alternatively from about 45° C. to about 65° C., alternatively from about 45° C. to about 55° C., alternatively from about 60° C. to about 65° C. The mixture can be agitated for a sufficient time (e.g., approximately from about 2 to about 10 minutes), with agitation preferably set at a slow speed (e.g., at from about 160 to about 200 rpm).

The resultant fabric softener mixture can be subsequently cooled to about or under the lowest phase transition (recrystallization/solidification) temperature of the fabric softening actives as determined using DSC. For example, when a mixture of STEPANTEX® VT-90 ester quat and SAPDMA are used as the fabric softening actives, the dispersion can be cooled to a temperature from about 20° C. to about 29° C., alternatively from about 22° C. to about 28° C., alternatively from 24° C. to 27° C. The cooling is preferably done quickly, for example, at a rate of from about 1° C. to about 15° C., alternatively from about 4° C. to about 10° C. per minute. Although not intending to be bound by any particular theory, it is believed that cooling of the fabric softener mixture helps faun a bi-layer or multi-layer lamellar gel network or a liquid crystal gel network.

As an option for quick cooling the fabric softener mixture, the low energy emulsification method can be used. According to this method, the molten pre-mix comprising the fabric softening compound and amine from the first container can be dispersed or dissolved in a proper low amount of warm water (e.g., at about 35° C. to 65° C.) to form a concentrated dispersion with good mixing, followed by the addition of a sufficient amount of cold water (e.g., at about 5° C. to 20° C.) in order to dilute the concentrated fabric softener mixture to a pre-determined low active concentration. In this case, the dispersion temperature can drop instantly to the preferred acidification temperature at about or under the phase transition temperature as described above.

If the pH of the fabric softener mixture is above 7.0 or a desired range, the pH of the mixture can then be adjusted to between about 1.5 to about 7.0, alternatively between about 2 to about 5.0, alternatively between about 2.5 to 4.0, with an acid at temperatures at about or under, preferably within about ±10° C., alternatively about ±5° C., alternatively about ±3° C., of, the lowest phase transition temperature of the dispersed fabric softening active or actives. The acid is preferably added to the mixture slowly as a solution with agitation, more preferably with slow agitation. The fabric softener mixture can then be further cooled to room temperature, for example about 25° C. if the acidification temperature is above about 25° C. Optionally, the resultant fabric softener composition can be re-heated to an elevated temperature (e.g., at about 40° C.) for a period of time (e.g., approximately 10 minutes) without stirring before being cooled to room temperature.

Optionally but preferably, a proper amount of at least one electrolyte can be added to the fabric softener composition as described above, for example, in Process Option 1.

Process Option 3:

Depending on the formulation of the final fabric softener product, a proper amount of at least one long chain amine of the present technology, a derivative thereof, or a mixture thereof can be added to a proper amount of water at a temperature of from about 25° to about 70° C., alternatively from about 35° C. to about 65° C., alternatively from about 45° C. to about 65° C., alternatively from about 45° C. to about 55° C., alternatively from about 60° C. to about 65° C. to form a mixture. The mixture can be agitated for a sufficient period of time (e.g., about 3 minutes or more) under the condition of low shear agitation until the amine is dispersed.

A sufficient amount of an acid, preferably an polyhydric acid as described above can be added to the mixture to produce a long amine salt or long chain amine quat solution having a pH value within the range of from about 1.5 to about 7.0, alternatively from about 2.0 to about 5.0, alternatively from about 2.5 to about 4.0, while the temperature is maintained at from about 25° C. to about 70° C., alternatively from about 35° C. to about 65° C., alternatively from about 45° C. to about 65° C., alternatively from about 45° C. to about 55° C., alternatively from about 60° C. to about 65° C. When a long chain amine quat is used and the pH value is already within the desired range, no acid may be needed to neutralize the solution. Preferably, the acid is added slowly as a solution.

The temperature of the long chain amine salt or amine quat solution can then be cooled to room temperature within the range of from about 20° C. to about 30° C., e.g., about 25° C. The cooling is preferably done quickly, for example, at a rate of from about 1° C. to about 10° C. per minute, alternatively from about 4° C. to about 5° C. per minute when the amine salt solution can become, for example, a gel. As an option for quick cooling, the low energy emulsification method as described above can be used.

Optionally but preferably, a pre-determined amount of at least one electrolyte in the amount of up to about 3% by weight based on the total weight of the final fabric softener composition can be added to the amine salt solution in a manner as described above.

In a separate vessel, depending on the formulation of the final fabric softener composition to be produced, a proper amount of an additional fabric softening active comprising, for example, an ester quat can be dispersed in water at from about 25° C. to about 70° C., alternatively from about 35° C. to about 65° C., alternatively from about 45° C. to about 65° C., alternatively from about 45° C. to about 55° C., alternatively from about 60° C. to about 65° C. alternatively from about 35° C. to about 55° C. under agitation to form a fabric softener dispersion. The dispersion can be cooled to room temperature, e.g., about 25° C. Again, the cooling is preferably done quickly, for example, at a rate of from about 1° C. to about 10° C. per minute, alternatively from about 4° C. to about 5° C. per minute. The low energy emulsification method as described above can also be used. The pre-formed long chain amine salt or amine quat solution as described above can be added to the fabric softener dispersion with agitation to form a fabric softener composition of the present technology. Preferably, the pre-formed long chain amine salt or amine quat solution is added slowly with minimal agitation.

Process Option 4:

Depending on the formulation of the final fabric softener product, a proper amount of at least one suitable long chain amine salt or amine quat of the present technology or a mixture thereof, and optionally an additional suitable fabric softening quat, can be added to a proper amount of water and/or suitable solvent at a temperature of from about 25° to about 70° C., alternatively from about 25° C. to about 55° C. with mixing. The mixture is cooled to from about 20° C. to about 30° C. The pH of the mixture can be adjusted to a desired range, preferably of from about 1.5 to about 7, using an acid or base. The viscosity of the mixture can be adjusted to a desired value of from about 100 cps to about 4000 cps using at least one electrolyte as discussed above. This process option is preferred for a clear isotropic fabric softener composition.

In addition to fabric softeners compositions, especially, low active, high viscosity fabric softeners, the presently described technology can also be used for the development of hair conditioner technology, high viscosity textile/fiber treatment applications, and the like. Long chain amine and polyfunctional acid systems may also be used as thickening systems in some surfactant based systems.

The presently described technology and its advantages will be better understood by reference to the following examples. These examples are provided to describe specific embodiments of the present technology. By providing these specific examples, the applicants do not limit the scope and spirit of the present technology. It will be understood by those skilled in the art that the full scope of the presently described technology encompasses the subject matter defined by the claims appending this specification, and any alterations, modifications, or equivalents of those claims.

As shown in the examples, the cooling condition (preferably quick cool such as at a rate of about 4-5° C. per minute), followed by the addition of the appropriate acid, preferably at about or under the phase transition temperature, with agitation (preferably slow agitation), allows the formation of the long chain amine salt in situ to achieve improved high viscosity in an accelerated manner. The examples also show that the addition of an electrolyte contributes to an additional increase in viscosity and improved high temperature stability for the resultant fabric softener compositions of the present technology.

In the examples, viscosities of the fabric softener dispersions are determined using a Brookfield RV viscometer. Their pH values are measured using an OKTON brand pH meter. Every sample noted in the examples is equilibrated for at least 2 hours at 25° C. or the temperature noted before viscosity and pH measurements are made.

EXAMPLES

Materials

STEPANTEX® VT-90 (methyl bis[ethyl (partially hydrogenated tallowate)]-2-hydroxyethyl ammonium methyl sulfate) is an ester quat commercially available from Stepan Company, Northfield, Ill. STEPANTEX® VT-90 ester quat contains a combination of hard and soft tallows and isopropyl alcohol. STEPANTEX® VT-90 ester quat is used herein as an example of a suitable ester quat for use in the presently described technology.

Other materials used include, but are not limited to, STEPAN® SAA (stearylamidopropyl dimethyl amine, i.e., SAPDMA); ACCOSOFT® 440-75 (methyl bis(hydrogenated tallow amidoethyl)-2-hydroxyethyl ammonium methyl sulfate); ACCOSOFT® 275 (dihydrogenated tallow dimethyl ammonium chloride (DHTDMAC)); Agent 1, which is a hard tallow triglyceride based ester quat (methyl bis[ethyl (hydrogenated tallowate)]-2-hydroxyethyl ammonium methyl sulfate, based on triglyceride); Agent 2, which is a hard tallow fatty acid based ester quat (methyl bis[ethyl (hydrogenated tallowate)]-2-hydroxyethyl ammonium methyl sulfate, based on fatty acid); Agent 3, which is diethanolester dimethyl ammonium chloride (DEEDMAC); AMMONYX® SDBC, which is a SAPDMA quat (Stearamidopropalkonium Chloride) available from Stepan, Northfield, Ill.

Example 1

Making a First Low Active, High Viscosity Composition Comprising STEPANTEX® VT-90 ester Quat and SAPDMA Process Option 1 as described above is used in this example to make a fabric softener composition using STEPANTEX® VT-90 ester quat and SAPDMA as the fabric softening actives.

Water (898.8 g) is heated to from about 63° C. to about 65° C. SAPDMA (10 g) are added to the heated water and agitated to disperse. STEPANTEX® VT-90 ester quat (44.4 g) is then added and agitated for about 3-10 minutes. The mixture is quickly cooled with iced-water to below the re-crystallization temperature of the mixture of STEPANTEX® VT-90 ester quat and SAPDMA at about 27° C. The pH of the mixture is adjusted to about 2.6 with 1N $H_2SO_4$ solution (about 26.8 g). 20% $CaCl_2$ solution (about 20 g) is then added with slow mixing. The agitation stops.

The fabric softener composition produced is tested for its properties, and the results are presented in Table 1 as Example 1.

Example 2

Making a Second Low Active, High Viscosity Composition Comprising STEPANTEX® VT-90 ester Quat and SAPDMA Process Option 2 as described above is used in this example to make a fabric softener composition using STEPANTEX® VT-90 ester quat and SAPDMA as the fabric softening actives.

STEPANTEX® VT-90 ester quat (200 g) is premixed with SAPDMA (20 g) at about 9:1 active ratio in a covered glass container at about 70° C. for approximately about 10 minutes, until a homogenous blend is obtained. Deionized (DI) water (876.1 g) is then loaded into a glass vessel and heated to about 55° C. The molten pre-mix of STEPANTEX® VT-90 ester quat/SAPDMA (about 76.9 g) is dispersed in the heated DI water at about 55° C. and mixed well for about 2 to about 3 minutes at about 200 rpm using a U shape mixer. The mixture is cooled down with iced-water to about 27° C., and the mixing speed is reduced to about 160 rpm. A 1N $H_2SO_4$ solution (about 18 g) is slowly added to the mixture at about 27° C. while keeping the same agitation. The mixture is further cooled, and a 20% $CaCl_2$ solution (about 20 g) is then added very slowly (in droplets) into the mixture at about 25° C. with slow mixing. After a fragrance (about 9 g) is added, mixing is stopped.

The fabric softener composition produced is tested for its properties, and the results are presented in Table 1 as Example 2.

Example 3

Making a Third Low Active, High Viscosity Composition Comprising Hard Tallow triglyceride ester Quat and SAPDMA This example uses the Process Option 1 described above to produce a fabric softener composition using SAPDMA and hard tallow triglyceride (HTTG) ester quat as the fabric softening actives. SAPDMA (about 8 g) and stearyl alcohol (about 3 g) are added to water (about 926.1 g) at about 65° C. and mixed for approximately 3 minutes with low shear agitation. Pre-melted HTTG ester quat (about 25.9 g) is slowly added to the water with continuous mixing for about 5 minutes while maintaining the temperature at about 55° C. The dispersion is quickly cooled to about the phase transition (re-crystallization/solidification) temperature of the dispersed mixture of HTTG ester quat and SAPDMA at about 38° C. determined by using DSC.

The pH of the fabric softener dispersion is then adjusted to about 3.9 with a 1N sulfuric acid solution (about 22 g), under the phase transition temperature of about 38° C. This allows the SAPDMA salt formation to achieve improved high viscosity in an accelerated manner.

The fabric softener composition is cooled to about 25° C. using slow agitation. A NaCl 20% solution (about 15 g) is then added to achieve the desired viscosity of about 1,000-1,500 cps.

The fabric softener composition produced is tested for its properties, and the results are presented in Table 1 as Example 3.

Example 4

Making a Fourth Low Active, High Viscosity Composition Comprising a Premix of STEPANTEX® VT-90 ester Quat and SAPDMA at a 9:1 Active Ratio In this example, Process Option 2 together with the alternative low energy emulsification method for cooling as described above are used to manufacturing a fabric softener composition using STEPANTEX® VT-90 ester quat and SAPDMA as the fabric softening actives.

A molten pre-mix (about 54.9 g) comprising STEPANTEX® VT-90 ester quat and SAPDMA at 9:1 active ratio is added to a vessel containing water (about 302.7 g) at about 45° C. and equipped with a high shear mixer to form a concentrate (about 15% active). Following the addition of the molten premix, the batch is agitated for about 3 minutes with high agitation. A proper amount of cold water (about 605.4 g) at about 20° C. is then added to the concentrate and the temperature of the dispersion instantly dropped to about 27° C.

The pH of the dispersion is slowly adjusted to 2.4 with a 1N Sulfuric Acid solution (about 22 g). This allows the SAPDMA salt formation to achieve an improved higher viscosity in an accelerated manner. After that, a 20% $Na_2SO_4$ solution (about 10 g) is slowly added to the fabric softener dispersion with minimal agitation. After a fragrance (about 5 g) is added, mixing is stopped.

The fabric softener composition produced is tested for its properties, and the results are presented in Table 1 as Example 4.

Example 5

Making a Fifth Low Active, High Viscosity Composition Comprising STEPANTEX® VT-90 ester Quat and SAPDMA Salt Solution Process Option 3 as describe above is used in this example to make a fabric softener composition. According to this method, SAPDMA (about 7 g) is added to a proper amount of DI water (about 461 g) at about 65° C., and mixed for about 3 minutes with low shear agitation. A 1N sulfuric acid solution (22 g) is slowly added to form the salt of SAPDMA with the temperature maintained at about 65° C., followed by quick cooling to about 25° C. A pre-determined amount of electrolyte (10 g, 20% $Na_2SO_4$ solution) is then added to the solution.

In a separate vessel, STEPANTEX® VT-90 ester quat (70 g) is dispersed in water (about 421 g) at about 50° C. under agitation. The dispersion is then quickly cooled to about 25° C. The SAPDMA salt solution produced above (about 500 g) is then slowly added to the ester quat dispersion with minimal agitation. After a fragrance (about 9 g) is added, mixing is stopped.

The fabric softener composition produced is tested for its properties, and the results are presented in Table 1 as Example 5.

Example 6

Comparative Study of the Fabric Softener Compositions of Examples 1-5 and Two Controls In this example, the five compositions prepared in Examples 1-5 are evaluated and compared with compositions of Controls 1 and 2. The Control 1 composition contains 7% by weight of STEPANTEX® VT-90 ester quat, and the Control 2 composition contains 3% by weight of HTTG ester quat.

The viscosity data (both initial and after kept for eight weeks at 45° C., 25° C., and 5° C.) of these compositions are recorded in Table 1. The results show that the compositions of Examples 1-5 all have excellent viscosities as compared to the compositions of Controls 1 and 2. The results also show that the compositions of Examples 1-3 and 5 have better stability at either high or low temperature.

Example 7

Comparative Study of 5% active fabric softener compositions

In this example, compositions of Controls 3-4 and F1-F11 are prepared. The formulations of them are shown in Table 2. These compositions are then evaluated for their viscosity properties. All 14 formulations, as shown in Table 2, include a total of 5% or about 5% by weight solids (active ingredients).

The viscosity data (both initial and after four weeks) of these compositions are recorded in Table 2. Comparing to the compositions of Controls 3 and 4, the Compositions F1-F11 containing rheology modifying fabric softening agents, such as SAPDMA, long chain ester amine, or long chain alkyl amine, have much higher viscosity.

The results also show that Compositions F1-F4 have good viscosity stability at room temperature after 4 weeks. There is essentially no change when compared to its initial viscosity.

TABLE 1

Comparative Study of the Fabric Softener Compositions Made in Examples 1-5

| Ingredients (weight % actives) | | Control 1 | Control 2 | Example 1 | Example 2 | Example 3 | Example 4 | Example 5 |
|---|---|---|---|---|---|---|---|---|
| Water | | QS | QS | QS | QS | QS | QS | QS |
| STEPANTEX ® VT-90 | | 7 | | 4 | | | | 6.3 |
| Agent 1 | | | 3 | | | 2.2 | | |
| STEPAN ® SAA (SAPDMA) | | | | 1 | | 0.8 | | |
| STEPANTEX ® VT-90/SAPDMA 9:1 | | | | | 7 | | 5 | |
| SAPDMA Salt (1.4% solids) | | | | | | | | 0.81 |
| Stearyl Alcohol | | | | | | 0.3 | | |
| $H_2SO4$ | | | | 0.134 | 0.09 | 0.11 | 0.11 | |
| NaCl | | | | | | 0.3 | | |
| $CaCl_2$ | | | | 0.4 | 0.4 | | | |
| $Na_2SO_4$ | | | | | | | 0.2 | 0.2 |
| Fragrance | | | | | 0.9 | | 0.5 | 0.9 |
| Viscosity (cps) | | 35 | 40 | 640 | 300 | 1,450 | 360 | 360 |
| pH | | 3 | 4.2 | 2.8 | 3.1 | 3.9 | 2.4 | 2.7 |
| Viscosity (cps)/pH | 8 wks.@ 25° C. | 40/3 | 60/4 | 690/2.9 | 260/3.1 | 1,280/3.9 | n/a | 340/2.6 |
| | 8 wks.@ 45° C. | 100/2.9 | gel/3.6 | 440/3 | 360/3.1 | 255/3.5 | n/a | 480/2.4 |
| | 8 wks.@ 5° C. | 60/3 | 240/4.2 | n/a | 340/3.1 | 1,340/3.9 | n/a | 360/2.6 |
| | after 3 F/T | n/a | 190/4.2 | n/a | 420/3.1 | 300/3.9 | n/a | N/A |

* QS: adding water to 100%; F/T: freeze/thaw study; wks.: weeks

TABLE 2

Formulation Examples for Low Active High Viscosity Fabric Softener Dispersions (Weight % Actives)

| Ingredients | Control 3 | Control 4 | F1 | F2 | F3 | F4 | F5 | F6 | F7 | F8 | F9 | F10 | F11 |
|---|---|---|---|---|---|---|---|---|---|---|---|---|---|
| Agent 2 | 5 | | 4.5 | 4.5 | 4.5 | 4.5 | 4 | | 4 | | | | 4.5 |
| STEPANTEX ® VT-90 | | | | | | | | 4 | | | | | |
| Agent 1 | | | | | | | | | | | | 4.5 | |
| ACCOSOFT ® 440-75 | | | | | | | | | | 4.5 | | | |
| ACCOSOFT ® 275 | | 5 | | | | | | | | | 4 | | |
| STEPAN ® SAA (SAPDMA) | | | 0.5 | 0.5 | 0.5 | | | 1 | 0.3 | 0.5 | 1 | | 0.5 |
| Stearyl Dimethyl Ester Amine | | | | | | 0.5 | | | | | | | |
| Hard Tallow Ester Amine | | | | | | | 1 | | | | | | |
| Stearyl Dimethyl Amine | | | | | | | | | | | | 0.5 | |
| Fragrance | | | | | | | | | | | | | 0.3 |
| Stearyl Alcohol | | | | | | | | | 0.7 | | | | |
| NaCl | | | 0.5 | 0.1 | 0.1 | 0.1 | 0.6 | 0.4 | 0.8 | | 0.7 | | 0.1 |
| Initial pH (adjusted with citric Acid or sulfuric acid solution) | | | 3.6 | 3.5 | 4.2 | 3.6 | 3.2 | 4 | 3.5 | 3.6 | 5.5 | 2.75 | 4.0 |
| Initial viscosity (cps) | WT* | 70 | 2,000 | 750 | 1,050 | 800 | 1,100 | 750 | 800 | 3,300 | 1,100 | 1,500 | 800 |
| Viscosity after 4 weeks @ RT | | 110 | 2,350 | 700 | 1,050 | 700 | | | | | | N/A | |

*WT: water thin viscosity;
RT: room temperature.

Example 8

Viscosity and Stability Study of Fabric Softener Compositions Made Using SAPDMA or a SAPDMA Quat Three fabric softener compositions F12-F14 are prepared in accordance with the present technology. The formulations of F12-F14 are shown in Table 3.

Composition F12 is made from STEPANTEX® VT-90 ester quat and a SAPDMA quat (AMMONYX® SDBC, available from) using Process Option 3 as described above. Since SAPDMA quat is used, the dispersion of the ester quat and amine quat mixture has a pH of about 2.6, and therefore no acid is needed to neutralize the fabric softener composition F12. Composition F13 is made from a DEEDMAC based ester quat (Agent 3) and SAPDMA using Process Option 1 as described above. Composition F14 is made using Process Option 1. In Composition F14, SAPDMA is the only fabric softening active included, and no additional fabric softening active is used.

TABLE 3

Formulation Examples and Stability Data

| Ingredients (% active wt) | F12 | F13 | F14 |
|---|---|---|---|
| Water | QS | QS | QS |
| STEPANTEX ® VT-90 | 6.3 | | |
| Agent 3 | | 4 | |
| SAPDMA | | 1 | 1.4 |
| AMMONYX ® SDBC | 0.7 | | |
| $H_2SO_4$ | | 0.13 | 0.11 |
| Fragrance | 0.5 | | |
| $CaCl_2$ | | 0.1 | |
| $Na_2SO_4$ | 0.2 | | 0.2 |
| Viscosity (cps) | 340 | 300 | 320 |
| pH | 2.6 | 3.55 | 2.6 |

TABLE 3-continued

| Formulation Examples and Stability Data | | | |
|---|---|---|---|
| Ingredients (% active wt) | F12 | F13 | F14 |
| Viscosity | | | |
| 4 weeks @ RT/pH | n/a | 224/3.6 | 280/2.5 |
| 4 weeks @ 40° C./pH | n/a | 160/3.4 | n/a |
| 4 weeks @ 5° C./pH | n/a | 300/3.7 | n/a |

The initial viscosities and pH values of the three compositions are recorded in Table 3. The stability of Compositions F13 and F14 are studied and their viscosity data and pH values after four weeks are also recorded in Table 3. Three samples of Composition F13 are kept room temperature (RT), 40° C., and 5° C., respectively, for four weeks in the test. The stability of Composition F14 is only stored for four weeks at room temperature (RT).

All Compositions F12-F14 show excellent viscosity. Compositions F13 and F14 also demonstrate very good stability at room temperature. Composition 13 further shows good stability after freeze/thaw or an elevated temperature in the presently described study.

Example 9

Softening Evaluation for Low Solids, High Viscosity Fabric Softener Compositions by Towel Treatment Studies The equipment used in the towel treatment studies is a Sears Kenmore® washing machine model #110. The materials used include hand towels (25"×15", 86/14 cotton/polyester), Tide® powder laundry detergent, and the fabric softener compositions to be tested.

The treatment procedure of the towels is as follows:

(1) Pre-clean the washers: Tide® powder laundry detergent (10 g) is used to pre-clean each machine. The water temperature is set at Hot/Cold; the water level is set at low; and the cycle is set at Whole (turn control knob right until "15").

(2) Weigh the towels: Each bundle of towels (A's, B's, C's, etc.) is weighed, and then the amount of the 5% active fabric softener dispersion to be used is calculated. For example, if you want 0.2% fabric softening active (or active mixture) per towel, use the following equation:

Weight of towels×0.002=grams of the active(s) needed;

Grams of the active(s) needed÷active concentration of dispersion tested=grams of dispersion per load.

(3) Set the washers for towel treatment: Tide® powder laundry detergent (1.0 g per towel) is added to the washers. The water temperature is set at Hot/Cold setting (95° F./65° F.); the water level is set at low for 10 towels or less; and the wash cycle is set at Whole.

(4) Wash the towels: After the detergent is added on the bottom of the washer, which is set as above, the towels are unfolded and spread out in the washer.[13] The washer is tuned on by turning the main control knob to "Normal" and pulling it out.

(5) Treat the towels with softener: After the wash and the first spin cycle but before the rinse cycle begins, the washer is stopped by pushing in the main control knob. The towels are removed from the washer and shaken out. The washer is restarted and let fill until it is about half full. The softener composition to be tested is added in the calculated amount, and the washer is allowed to finish filling. The towels are added back to the washer as soon as the agitation begins, and the cycle is allowed to finish. After the rinse cycle, the towels are removed from the washer and shaken out.

The washed towels are hung over a line and left completely dried by air over-night. A dehumidifier is used when necessary to reduce the humidity to between 40% and 60% relative humidity. In the next day, all towels were folded, and each bundle is stored separately in closed plastic bags. The towels are kept in the bags for half day, and the panel test is then conducted on the same day by following a protocol detailed below.

The procedure and protocol for conducting the panel test are as follows:

(1) The towels are arranged in pairs with one evaluation sheet for each pair and its "duplicate". The towel pairs are set up randomly on the table. If there is a negative control (i.e., blank) treatment where no softener used to treat the towels, the first pair to be felt normally should include a negative control towel. For example, if testing 3 treatments, A, B, and C, there would be the following 3 sets of pairs: A versus B, A versus C, and B versus C. If testing 4 treatments, A, B, C, and D, there would be 6 sets of pairs: A versus B, A versus C, A versus D, B versus C, B versus D, C versus D.

(2) Each panelist thoroughly washes and dries his or her hands.

(3) The panelist must feel each set of paired towels and pick the softer of the two. They must choose one. A "no difference" is unacceptable. They are forced to choose one. If there is truly "no difference", the final tally will show that they are equal.

(4) There are 20 people (panelist) on the panel. In head to head comparisons, a 15 to 5 or higher score means that the pairs are not equal and there is a statistical difference in softening performance, while a 14 to 6 or lower score means that the pairs are equal and there is no statistical difference in softening performance.

In this example three treatments are done for each panel test. In the first panel test, one of the three treatments is a blank treatment with no fabric softener is used in the rinse cycle, i.e., a negative control treatment. Two freshly made fabric softener compositions that have been cooled to room temperature are used in the other two treatments, which are (1) a 5% active dispersion of the present application that is made from. STEPANTEX® VT-90 ester quat and SAPDMA in a 4:1 active ratio containing $CaCl_2$ as the electrolyte (the "VT90/SAPDMA/$CaCl_2$" dispersion); and (2) a 5% active comparative dispersion of STEPANTEX® VT-90 ester quat (the "VT90" dispersion). The amount of the fabric softening active(s) used for the two treatments is 0.1% by weight based on the total weight of the towels to be treated. The result of the first panel test is shown in FIG. 4.

In the second panel test, one of the three treatments is still a negative control treatment. In the other two treatments, the 5% active VT90/SAPDMA/$CaCl_2$ fabric softener dispersion and the comparative 5% active VT90 dispersion, after being stored at 45° C. for 12 weeks, are used, respectively. The amount of the fabric softening active(s) used is still 0.1% by weight based on the total weight of the towels to be treated. The result of the second panel test is shown in FIG. 4.

Figure 4:
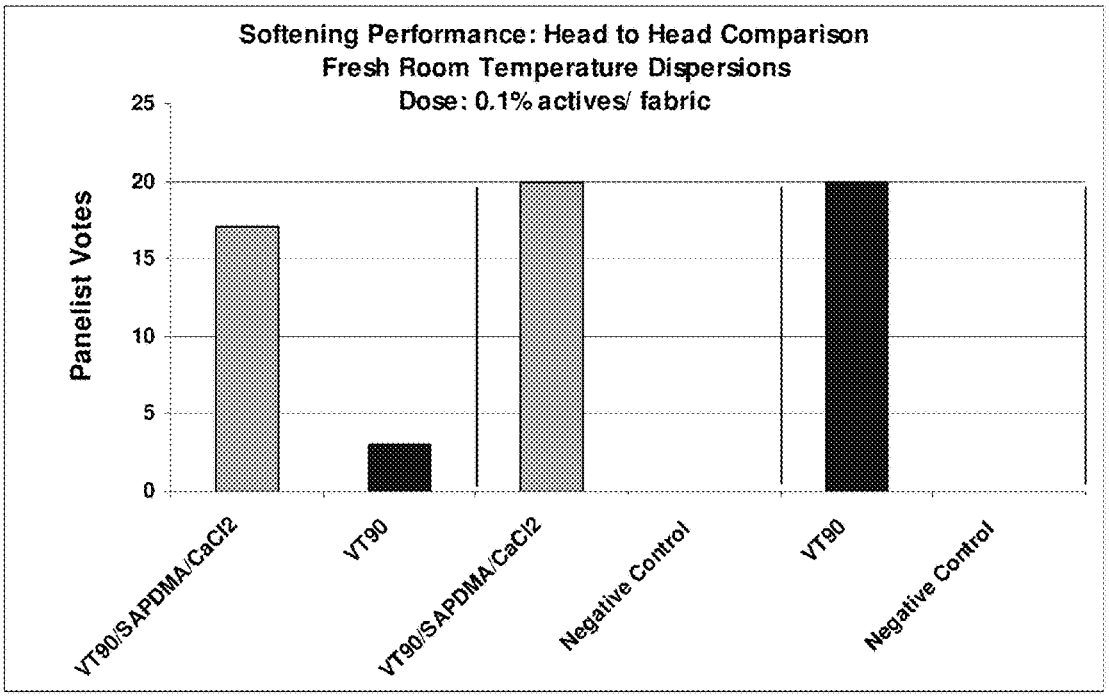
FIGS. 4 and 5 show the comparative test results of softening performance of a 5% active fabric softener composition of the present technology based on a mixture of STEPANTEX® VT-90 ester quat and SAPDMA at a ratio of about 4:1 and a 5% active fabric softener composition based on STEPANTEX® VT-90 ester quat alone. The test in FIG. 4 is performed when the two fabric softener compositions are freshly prepared, and the test in FIG. 5 is performed after the two fabric softener compositions are stored at 45° C. for 12 weeks.
Figure 5:
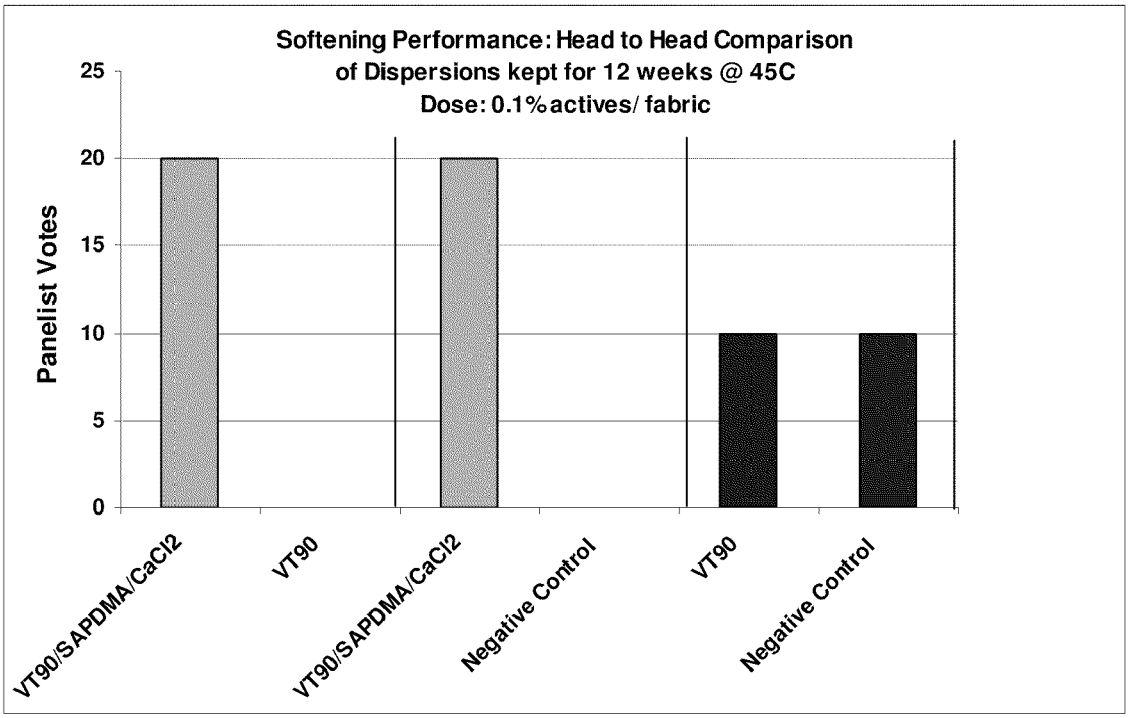

The graphs in FIGS. 4 and 5 show a statistical improvement in softening performance of the dispersion based on STEPANTEX® VT-90 ester quat and SAPDMA as compared to the dispersion based on STEPANTEX® VT-90 ester quat itself. FIG. 5 also shows that after 12 weeks storage at 45° C., the VT90 dispersion lost its softening performance almost completely, presumably due to the hydrolytic instability, while the VT90/SAPDMA/$CaCl_2$ dispersion remains active over high temperature storage and still provides softening on fabric because of the incorporation of SAPDMA salt in the dispersion.

In the third panel test, three fabric softener compositions are used in the three treatments. The three fabric softener compositions are:

(1) a 1.4% by weight SAPDMA salt solution;

(2) a 3% by weight active fabric softener dispersion based on STEPANTEX® VT-90 ester quat (the "VT90" dispersion); and (3) a 3% by weight active fabric softener dispersion based on STEPANTEX® VT-90 ester quat and SAPDMA in a 2:1 active ratio with NaCl as the electrolyte (the "VT90/SAPDMA/SA/NaCl" dispersion).

Figure 6:
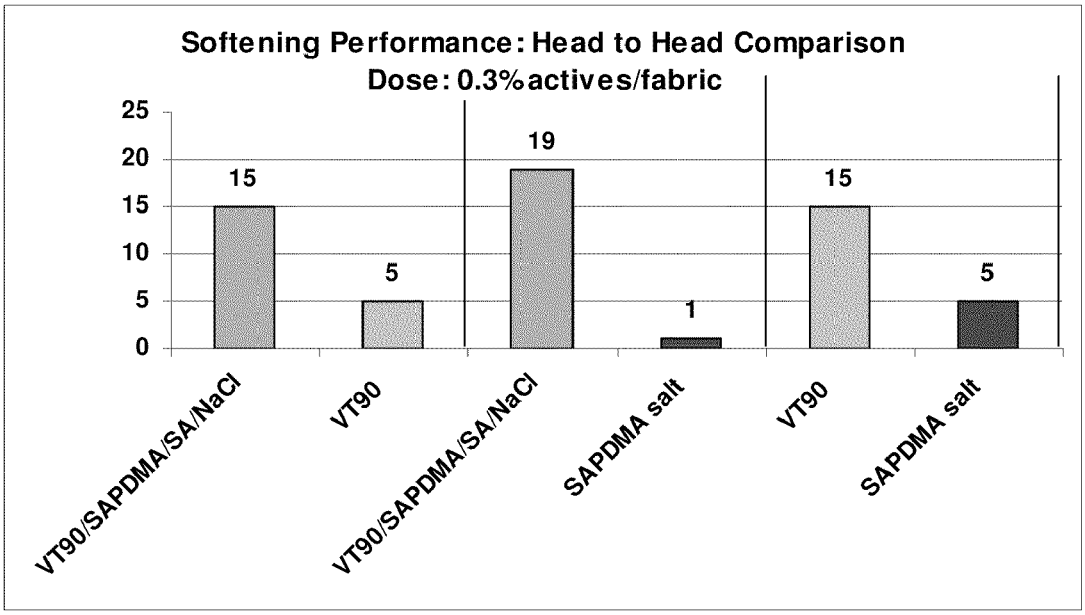
FIG. 6 shows the comparative test results of softening performance of a 1.4% active SAPDMA salt solution, a 3% active fabric softener composition based on STEPANTEX® VT-90 ester quat alone, and a 3% active fabric softener composition based on a mixture of STEPANTEX® VT-90 ester quat and SAPDMA at a ratio of about 2:1.

The above compositions are used in the amount of 0.3% by weight of the solids in the compositions based on the weight of the towels to be treated. The panel test results are shown in FIG. 6. The results show a synergy for the softening performance between STEPANTEX® VT-90 ester quat and SAPDMA salt, because the combination of them gives statistically better performance on fabric as compared to either component used alone. The results also show that SAPDMA salt has been picked by 5 panelists as better than STEPANTEX® VT-90 ester quat. Therefore, SAPDMA salt shows a slightly softening ability.

The present technology is now described in such full, clear, concise and exact terms as to enable any person skilled in the art to which it pertains, to practice the same. It is to be understood that the foregoing describes preferred embodiments of the invention and that modifications may be made therein without departing from the spirit or scope of the present technology as set forth in the appended claims.

The invention claimed is:

1. A process for making a fabric softener composition, comprising the steps of:

adding a rheology modifying fabric softening active comprising a long chain amine, a derivative thereof, or a mixture thereof to water at a temperature of between about 25° C. and about 70° C. to form a mixture, wherein the long chain amine has a general chemical structure of:

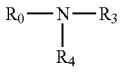

wherein, $R_0$ has a structure of $R_1$—A—$R_2$, where $R_1$ is a $C_{5-30}$ alkyl, alkylene, or alkenyl group, A is

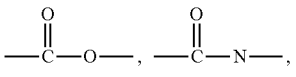

or

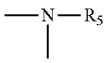

where $R_5$ is a $C_{1-6}$ alkyl or alkylene group, a hydrogen, or a polyamine, $R_2$ is a $C_{1-6}$ alkylene group, a $C_{1-30}$ alkoxylated group, or a covalent bond, and $R_3$ or $R_4$ independently is the same as $R_1$—A—$R_2$, a $C_{1-5}$ alkyl group, or a hydrogen;

adding a quaternary amine fabric softening active to the mixture at a temperature of between about 25° C. and about 70° C;

cooling the mixture to a temperature at about 10° C. below to about 10° C. above the re-crystallization/solidification phase transition temperature of the dispersed fabric softening active or actives; and in-situ adjusting the pH of the long chain amine, derivative thereof or mixtures thereof and the quaternary amine fabric softening active to a pH in the range of about 1.5 to about 7.0 by adding a polyprotic acid at about or under the re-crystallization/solidification phase transition temperature of the fabric softening active or actives to form the fabric softener composition.

2. The process of claim 1, further comprising the step of adding an electrolyte to the fabric softener composition in an amount of up to about 3% by weight based on the total weight of the composition.

3. The process of claim 1 where the fabric softening composition has an initial viscosity of at least 100 cps at 25° C.

4. The process of claim 1, wherein the long chain amine is derived from a stearyl, behenyl, oleyl, soya, palm stearine, palm kernel, palm, tallow, tall, sunflower, safflower, canola, castor, sesame, cotton seed, coconut, or babassu source, a derivative thereof, or a mixture thereof.

5. The process of claim 1, wherein the long chain amine is a member selected from the group consisting of dioctyl amine, stearyl dimethyl amine, palmityl dimethyl amine, oleocetyl dimethyl amine, oleyl dimethyl amine, stearyl amidoethyl diethyl amine, behenyl amidopropyl dimethyl amine, stearyl amidopropyl dimethyl amine, stearyl amidopropyl diethyl amine, oleyl amidopropyl dimethyl amine, stearyl amidoethyl dimethyl amine, stearyl dimethyl ester amine, derivatives thereof, and combinations thereof.

6. The process of claim 1, wherein the acid is sulfuric acid, phosphoric acid, citric acid, maleic acid, adipic acid, boric acid, glutamic acid, succinic acid, or any combination thereof.

7. The process of claim 1 further comprising the step of adding a fatty alcohol to the water.

8. The process of claim 1, wherein the rheology modifying fabric softening active is added in an amount of from about 0.05% to about 10% by weight based on the total weight of the fabric softener composition.

9. The process of claim 1, wherein the additional fabric softening active is added in an amount of from about 1% to about 10% by weight based on the total weight of the fabric softener composition.

10. The process of claim 1, wherein the rheology modifying fabric softening active and the additional fabric softening active are added in a ratio of from about 10:1 to about 1:20 by weight.

11. A process for making a fabric softener composition, comprising the steps of:

making a concentrated pre-mix by adding a quaternary amine fabric softening active and a rheology modifying fabric softening active comprising a long chain amine, a derivative thereof, or a mixture thereof to water at a temperature of between about 35° C. and about 70° C. to form a homogeneous mixture, wherein the long chain amine has a general chemical structure of:

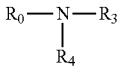

wherein, $R_0$ has a structure of $R_1$—A—$R_2$, where $R_1$ is a $C_{5-30}$ alkyl, alkylene, or alkenyl group, A is

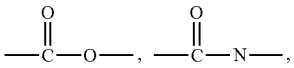

or

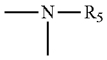

where $R_5$ is a $C_{1-6}$ alkyl or alkylene group, a hydrogen, or a polyamine, $R_2$ is a $C_{1-6}$ alkylene group, a $C_{1-30}$ alkoxylated group, or a covalent bond, and $R_3$ or $R_4$ independently is the same as $R_1$—A—$R_2$, a $C_{1-5}$ alkyl group, or a hydrogen;

cooling of the mixture to a temperature at about 10° C. below to about 10° C. above the re-crystallization/solidification phase transition temperature by the addition of a sufficient amount of cold water to dilute the mixture to a predetermined lower active concentration;

in-situ adjusting the pH of the long chain amine, derivative thereof or mixtures thereof and the quaternary amine fabric softening active to a pH in the range of about 1.5 to about 7.0 by adding a polyprotic acid at about or under the re-crystallization/solidification phase transition temperature of the fabric softening active or actives to form the fabric softener composition.

* * * * *